US010850166B1

(12) United States Patent
Zamora

(10) Patent No.: US 10,850,166 B1
(45) Date of Patent: Dec. 1, 2020

(54) SPORTS BALL WITH CONTROLLABLE TRAJECTORY

(71) Applicant: Jazmine Zamora, Ewa Beach, HI (US)

(72) Inventor: Jazmine Zamora, Ewa Beach, HI (US)

( * ) Notice: Subject to any disclaimer, the term of this patent is extended or adjusted under 35 U.S.C. 154(b) by 0 days.

(21) Appl. No.: 15/791,264

(22) Filed: Oct. 23, 2017

Related U.S. Application Data

(60) Provisional application No. 62/410,865, filed on Oct. 21, 2016.

(51) Int. Cl.
*A63B 37/14* (2006.01)
*A63B 43/00* (2006.01)
*A63B 69/00* (2006.01)

(52) U.S. Cl.
CPC ..... *A63B 37/14* (2013.01); *A63B 43/002* (2013.01); *A63B 2069/0008* (2013.01)

(58) Field of Classification Search
CPC ..... A63B 43/002; A63B 37/14; A63B 2069/0008; A63B 37/0011; A63B 43/00
USPC ..... 473/613, 600–602
See application file for complete search history.

(56) References Cited

U.S. PATENT DOCUMENTS 2,135,210 A * 11/1938 Farrar ..... A63B 37/0004 473/383
2,776,139 A * 1/1957 Blamey, Jr. ..... A63B 43/00 473/613
4,128,238 A * 12/1978 Newcomb ..... A63B 37/14 273/DIG. 20
4,144,297 A * 3/1979 Tomar ..... A63B 37/06 264/237
4,256,304 A * 3/1981 Smith ..... A63B 37/14 124/78
4,364,565 A * 12/1982 Tomar ..... A63B 37/06 264/45.5
4,438,924 A * 3/1984 Carr ..... A63B 37/14 473/613
4,725,058 A * 2/1988 Molitor ..... A63B 37/00 273/DIG. 5
4,772,019 A * 9/1988 Morgan ..... A63B 37/00 273/DIG. 8
4,840,378 A * 6/1989 Molitor ..... A63B 37/00 473/600

(Continued)

FOREIGN PATENT DOCUMENTS

GB 2097262 A * 11/1982 ..... A63B 37/14

OTHER PUBLICATIONS

Titleist. "Learning to Fly: Dimples and Golf Ball Design", Retrieved from the internet URL: <https://web.archive.org/web/20170502113633/http://www.titleist.com/teamtitleist/b/tourblog/archive/2014/12/18/learning-to-fly-dimples-and-golf-ball-design>. Available online Dec. 18, 2014.

(Continued)

*Primary Examiner* — Steven B Wong
(74) *Attorney, Agent, or Firm* — Hawaii Patent Services; Nathaniel K. Fedde

(57) ABSTRACT

This invention provides sports ball having asymmetrical traction and/or asymmetrical surface structure. The asymmetrical traction is useful for differentially controlling ball spin and trajectory height as the ball is projected from a pitching machine. The asymmetrical surface structure is useful for differentially controlling the lateral component of the ball's trajectory. Optionally, the ball is a pitching machine ball. The method also provides a method of projecting the ball from a pitching machine.

14 Claims, 11 Drawing Sheets

(56) References Cited

U.S. PATENT DOCUMENTS 4,874,169 A * 10/1989 Litchfield ..... A63B 37/14 473/613
4,919,422 A * 4/1990 Ma ..... A63B 37/14 273/DIG. 20
4,955,620 A * 9/1990 Reinke ..... A63B 65/00 473/596
5,033,743 A * 7/1991 Wright ..... A63B 43/00 273/DIG. 20
5,158,284 A * 10/1992 Vogl ..... A63B 43/00 273/DIG. 20
5,280,906 A * 1/1994 Vitale ..... A63B 43/00 273/DIG. 20
5,356,941 A * 10/1994 Sullivan ..... A63B 37/02 521/96
5,647,590 A * 7/1997 Walker ..... A63B 37/00 473/601
5,700,211 A * 12/1997 Mackie ..... A63B 43/00 473/613
5,893,808 A * 4/1999 Bennett ..... A63B 65/06 473/451
5,984,813 A * 11/1999 Cinnella ..... A63B 37/14 473/613
6,354,970 B1 3/2002 Reinke et al.
6,719,653 B1 * 4/2004 Nesbitt ..... A63B 37/02 473/600
6,837,814 B2 * 1/2005 Thomas ..... A63B 37/14 473/613
D539,367 S * 3/2007 Jones ..... D21/713
7,608,003 B1 * 10/2009 Fusco ..... A63B 43/00 473/613
D648,406 S * 11/2011 Hochberg ..... D21/713
D741,422 S * 10/2015 Holland ..... D21/713
2007/0155549 A1 * 7/2007 Keker ..... A63B 37/14 473/613
2008/0051233 A1 * 2/2008 Nesbitt ..... A63B 37/0023 473/602
2009/0137350 A1 * 5/2009 Lenig ..... A63B 39/00 473/451
2014/0274465 A1 * 9/2014 Francis ..... A63B 43/00 473/351
2017/0354850 A1 * 12/2017 Chen ..... A63B 39/00

OTHER PUBLICATIONS

Aerospaceweb. "Vortex Generators", Retrieved online from the URL:<http://www.aerospaceweb.org/question/aerodynamics/q0009.shtml>. Available online on Jan. 14, 2001.

Aerospaceweb. "Golf Ball Dimples & Drag", Retrieved online from the URL:<http://www.aerospaceweb.org/question/aerodynamics/q0215.shtm>. Available online on Feb. 13, 2005.

Choi et al., "Mechanism of drag reduction by dimples on a sphere", Phys. Fluids 18, 041702, 2006, Retrieved online from the URL:<http://biosport.ucdavis.edu/lab-meetings/Choi%20et%20al%20-%202006%20-%20Mechanism%20of%20drag%20reduction%20by%20dimples%20on%20a%20sphere.pdf>).

Baseballexpress. "Rawlings Curve Ball Hit Training Set (6 Pack)", Retrieved online from the URL:<http://www.baseballexpress.com/catalog/product.jsp?productId=119936>. Available online on Mar. 27, 2016.

* cited by examiner

SPORTS BALL WITH CONTROLLABLE TRAJECTORY

CROSS-REFERENCE TO RELATED APPLICATIONS

This application claims the benefit of U.S. Provisional Application No. 62/410,865 filed 21 Oct. 2017, which is hereby incorporated by reference.

TECHNICAL FIELD

The present invention relates to generally to sports balls, and more particularly to sports balls for use in pitching machines, particularly of the type having at least one drive wheel.

BACKGROUND

Pitching machines have become a staple of batting practice at all levels of play. One of the most popular types of pitching machines includes a rotating drive wheel that contacts the ball to project the ball towards the batter. The ball is fed, for example, through a ball chute and typically is pinched or squeezed as it is pulled under a pinch plate (sometimes called a bumper pad) by the wheel. This squeezing action forces the ball against the wheel and allows the wheel to project the ball. While these pitching machines can provide continuous batting practice for a batter, they typically only pitch a single trajectory that is straight at the batter with little or no variance in vertical trajectory.

One solution to this problem has been the multi-wheeled pitching machine which can pitch curveballs, sinkers, and other types of pitches by varying the relative speed of the multiple wheels that contact the ball. However, these pitching machines are expensive, making them less available to all levels of players, and have more parts, making them more prone to failure. Further, their size and portability provide additional limitations.

What is needed in the art is a pitching machine ball that can be projected from a single wheel pitching machine and provide the user with control over vertical and/or trajectory of the ball.

SUMMARY OF THE INVENTION

One aspect of the invention provides a sports ball having asymmetrical traction and/or asymmetrical surface shape. Another aspect of the invention provides a method of projecting ('pitching') the ball from a pitching machine having a drive wheel that contacts the ball.

For example, a ball of the present invention optionally comprises asymmetrical traction such that the ball surface comprises a plurality of portions with differing traction when independently interfaced with the drive wheel of a pitching machine. Additionally or alternatively, the ball is optionally asymmetrically shaped to differentially modulate relative air pressure about non-overlapping hemispheres as the ball travels through air. Such a ball having asymmetrically shaped to differently modulate air pressure is sometimes said to have a 'horizontal trajectory-controlling structure'.

Optionally, the asymmetrical traction and/or the asymmetrical shape is provided by a groove pattern.

Optionally, the ball comprises a non-perforated outer surface.

Optionally, the ball comprises a solid core. Optionally, the ball is substantially solid.

Optionally, the surface of the ball comprises a plurality of dimples. Optionally, the dimples are evenly spaced about the entire surface of the ball or a portion (e.g. hemisphere) thereof.

Optionally, the groove pattern comprises one or more arcuate grooves formed in the surface of the ball, wherein the one are more arcuate grooves are provided to a greater extent in a first hemisphere of the ball than a second hemisphere of the ball (e.g. to provide asymmetrical traction and/or asymmetrical surface shape), and wherein the path of the one are more arcuate grooves is non-perpendicular to an equator that joins the first hemisphere and the second hemisphere. Optionally, the path of the one or more arcuate grooves is substantially parallel to the equator. Optionally, the surface of the second hemisphere does not comprise said one or more arcuate grooves. Optionally, the one are more arcuate grooves are concentric about an axis of the ball that is perpendicular to the equator.

A method of the invention comprises placing the ball on a drive wheel of a pitching machine, and propelling the ball by spinning the drive wheel. According to a method of the present invention, the trajectory of the ball can be manipulated, relative to a comparator ball (e.g. a symmetrical ball and/or ball having the same composition but not modified according to the present invention) by differentially orienting the horizontal trajectory-controlling structure and/or asymmetrical traction in the step of placing the ball on the drive wheel. The step of placing the ball on a drive wheel can comprise any of:

a. orienting the ball of the invention to offset the horizontal trajectory-controlling structure to the right or left of a center plane of the drive wheel, whereby the ball of the invention is propelled about a trajectory offset to the right or left relative to the comparator ball;
b. orienting the ball of the invention on the drive wheel such that the wheel-ball interaction is dominated by the ball portion having greater traction, whereby the ball of the invention is propelled about a trajectory that is higher relative to when the ball of the invention is oriented such that the wheel-ball interaction is dominated by the ball portion having less traction; and
c. orienting the ball of the invention on the drive wheel such that the wheel-ball interaction is dominated by the ball portion having less traction, whereby the ball of the invention is propelled about a trajectory that is lower relative to when the ball of the invention is oriented such that the wheel-ball interaction is dominated by the ball portion having greater traction.

BRIEF DESCRIPTION OF THE DRAWINGS

FIG. 1A depicts a perspective view, shaded with stippling to show contour. FIG. 1B depicts a side elevation view. FIG. 1C depicts a front elevation view. FIG. 1D depicts a rear elevation view. FIG. 1E depicts a perspective view. FIG. 1F depicts a cross section view. The cross section to provide FIG. 1F is taken from a plane labeled as "1F" in FIG. 1C. FIG. 1G depicts an exploded view.

FIG. 3A depicts a higher trajectory ('high mode'). resulting from greater backspin. FIG. 3B depicts a lower trajectory ('low mode'). resulting from less backspin.

FIG. 6A depicts a perspective view, shaded with stippling to show contour. FIG. 6B depicts a cross section view. The cross section to provide FIG. 6B is taken from a plane oriented in the same manner with respect to the view shown in FIG. 6A as plane "1F" is oriented with respect to the view shown in FIG. 1C.

DETAILED DESCRIPTION OF THE INVENTION

Figure 1A:
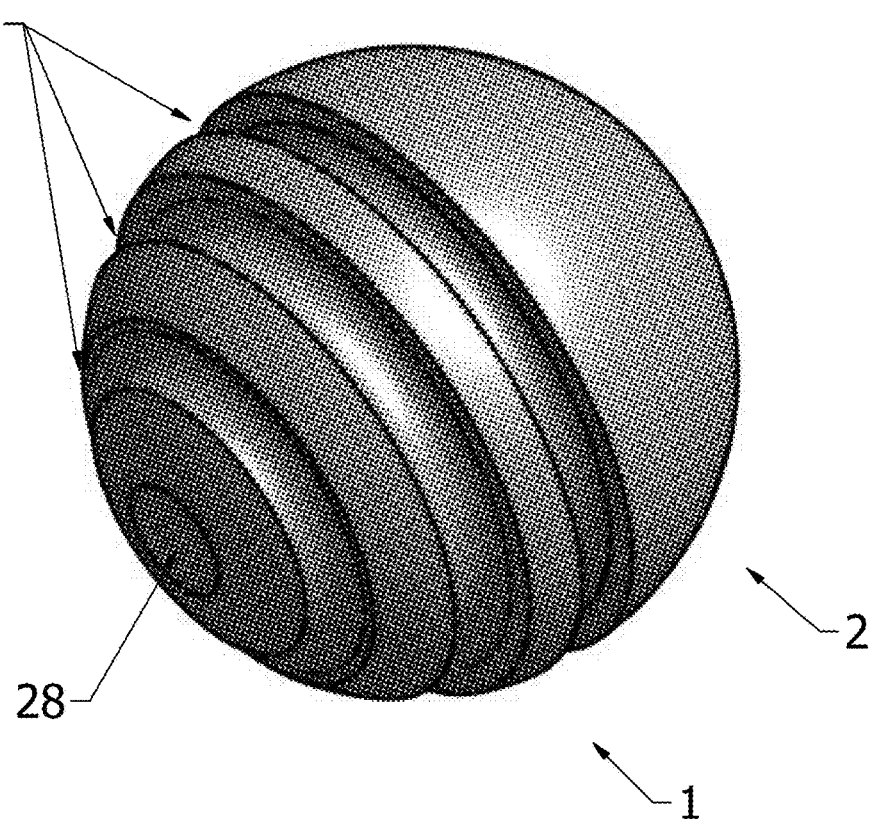
FIGS. 1A-1G depict views of a ball of the invention.
Figure 1B:
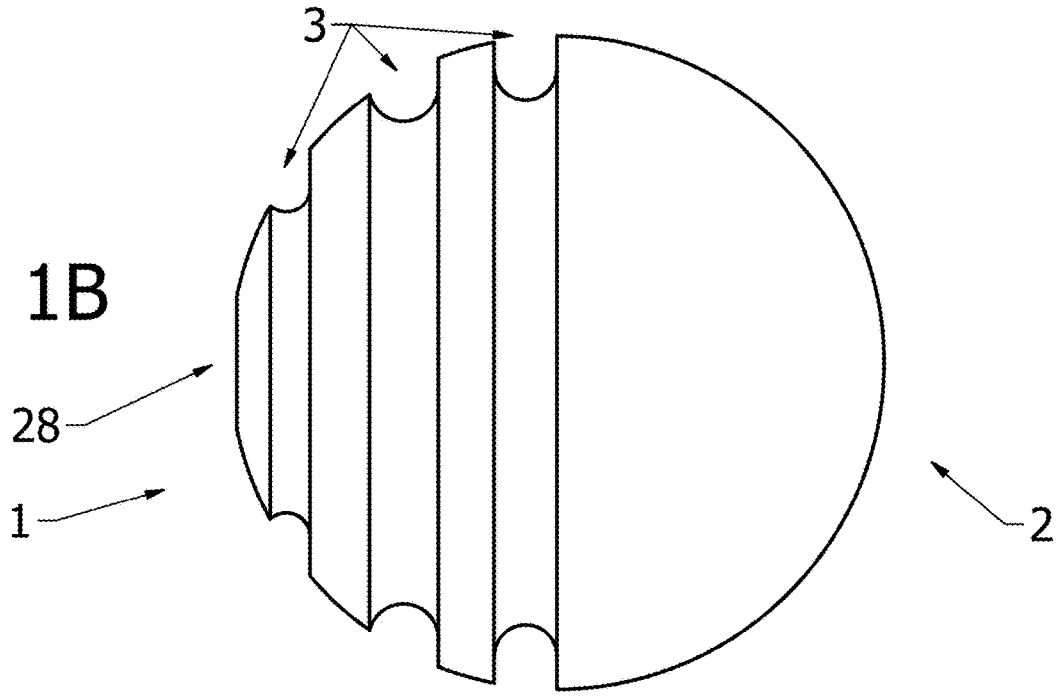
Figure 1C:
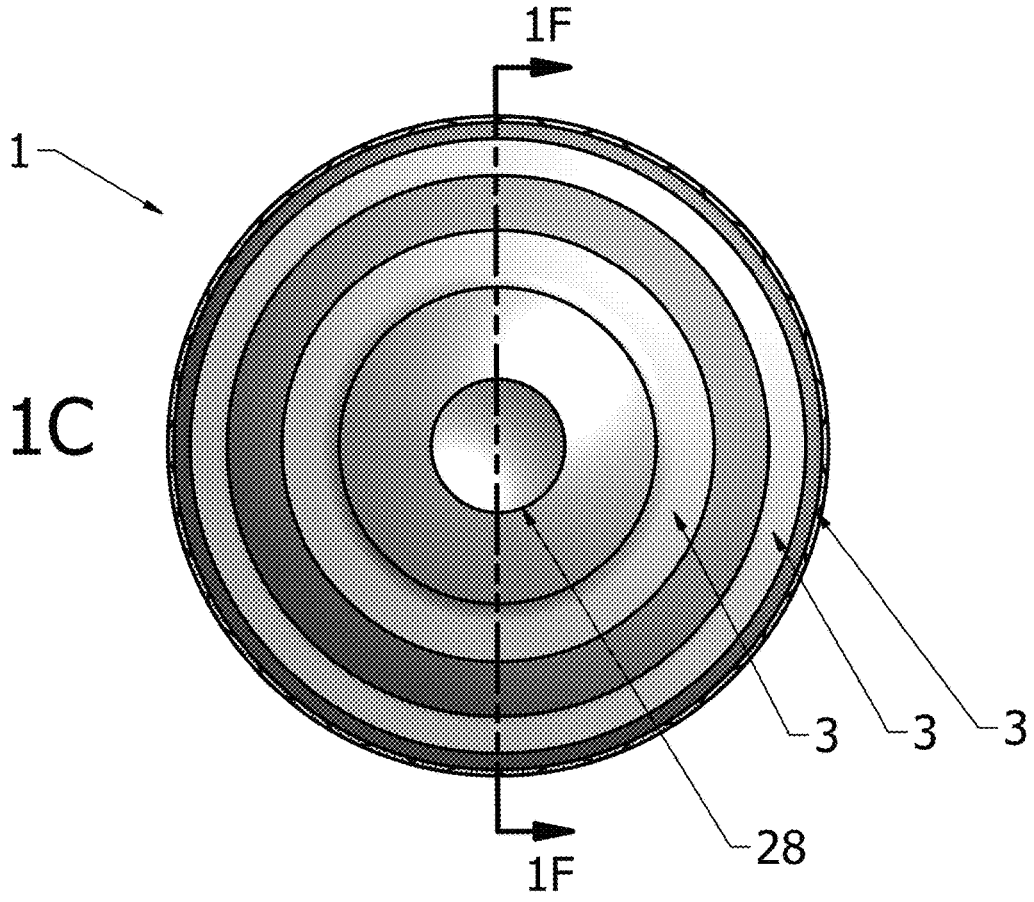
Figure 1D:
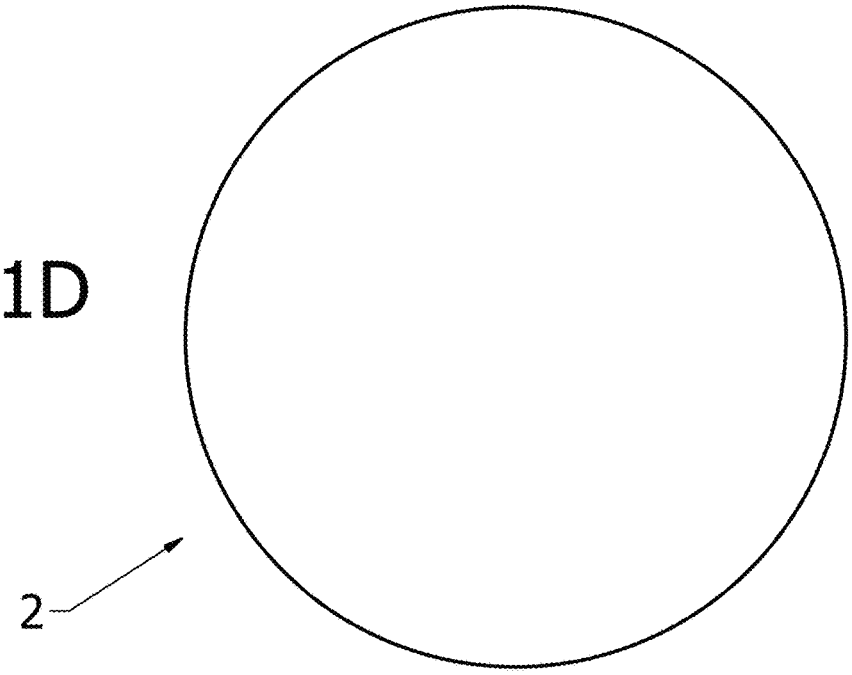
Figure 1E:
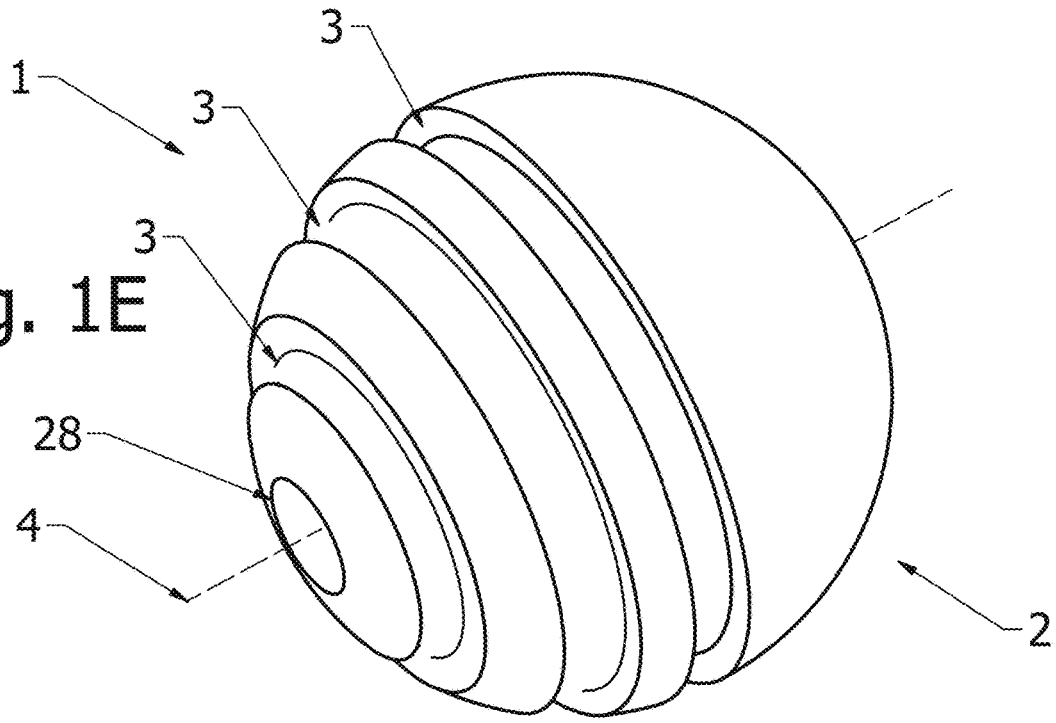

As used here, the following definitions and abbreviations apply.

"Exemplary" (or "e.g." or "by example" or "such as") means a non-limiting example.

"Asymmetrical" means a feature is more prevalent about a first hemisphere of a sports ball of the present invention relative to a second hemisphere of the sports ball, wherein the first hemisphere and the second hemisphere are joined by an equator.

"Coincident", as it refers to two geometries, means that the geometries share at least two points of intersection or overlap. For example, a vector (e.g. a ball's initial trajectory upon projection) and a plane are coincident when the vector lies on the plane. As another example, a vector and an equator (e.g. circle) are coincident when the vector and the equator lie on the same plane.

Overview of the Invention

A ball of the invention comprises a structural feature which controls vertical trajectory of the ball and/or a structural feature which controls horizontal trajectory of the ball.

A structural feature which controls vertical trajectory is configured to, when differentially oriented to interface the drive wheel in a dominant or weaker manner, dictate the vertical component of the ball's trajectory when the ball is projected from the drive wheel. This structural feature is a first portion (e.g. first hemisphere) of the ball surface imparting increased or decreased traction to the ball-wheel interface, relative to a second portion (e.g. second hemisphere) of the ball surface.

A structural feature which controls horizontal trajectory is configured to, when differentially oriented to one side or another (e.g. left or right) of a pitching machine drive wheel, dictate the horizontal component of the ball's trajectory when the ball is projected from the drive wheel.

The structural feature which imparts control of vertical trajectory is optionally the same or partially the same structural feature that imparts control of horizontal trajectory (e.g. grooves).

Accordingly, the horizontal and/or vertical components of the trajectory of a present ball can be dictated at-will by a user, e.g. even without a sophisticated pitching machine depending upon how the user loads the ball to a pitching machine. For example, a standard pitching machine having a single drive wheel can be used to propel a ball of the invention with at least four trajectories (e.g. high, low, left, and right).

Optionally, the invention contemplates a ball that can control both horizontal and vertical trajectory. Optionally, the ball comprises a hemisphere having a structural feature that controls both vertical and horizontal trajectory (e.g. as detailed in Example 1), such as one or more grooves asymmetrically positioned on one hemisphere. Alternatively, the height-controlling structure and the horizontal trajectory controlling feature may be different. Further, the height-controlling structure and the horizontal trajectory controlling feature may be on non-overlapping (i.e. opposite) hemispheres, or on overlapping hemispheres. For example, first and second non-overlapping hemispheres may be provided that are shaped such that they experience different air pressure to control the horizontal trajectory, and third and fourth non-overlapping hemispheres may be provided that impart different on-wheel traction to control the vertical trajectory. The first and second hemispheres may be the same as the third and fourth hemispheres (e.g. as in Example 1), respectively, or the first and second hemispheres may be different than (but overlapping with) the third and fourth hemispheres (e.g. where air pressure differences are imparted by a first surface shape and traction is induced by frictional coating or a second surface shape that still allows the first surface shape to control horizontal trajectory). Optionally, a height-controlling structure is oriented side up or side down on a drive wheel to control vertical trajectory. Optionally, horizontal trajectory structures are oriented on one side or another (e.g. left or right) on a drive wheel to control horizontal trajectory.

Control of Horizontal Trajectory

A ball of the invention optionally comprises a structural feature which controls horizontal trajectory of the ball (sometimes referred to herein as a 'horizontal trajectory controlling structure'). This structural feature is configured to, when differentially oriented laterally to a side or another (e.g. left or right) of a pitching machine drive wheel, dictate the horizontal component of the ball's trajectory when the ball is projected from the drive wheel. Such a horizontal trajectory controlling structure can be provided, e.g. by any asymmetrical ball shape.

The horizontal component of a present ball's trajectory can changed, for example, by imparting a trajectory with a curve or a projection angle offset relative to a normal projection angle (where the normal projection angle is perpendicular to the axis of rotation of a drive wheel).

Optionally, a ball of the invention is configured to curve. In-flight curvature can be imparted by providing a ball shape that creates different air pressure about opposing sides (e.g. left and right sides) of the ball as it travels through the air. Differential air pressure can be imparted, for example, by providing a ball with first and second hemispheres which experience or impart different air speeds adjacent to the ball surface. For example, an increased air speed across a first hemisphere can reduce air pressure about the first hemisphere. Conversely, reduced air speed across a first hemisphere can increase air pressure about the first hemisphere. The speed of air flowing across a hemisphere can be controlled, for example, by providing a hemisphere shape which increases or decrease the length of the path air travels across the hemisphere. Additionally or alternatively, differential air pressure can be imparted by providing first and second hemispheres which impart differential turbulence or vortices and/or differentially modify local boundary layer separation.

Relative to a perfect hemisphere, a first hemisphere of a ball of the invention can be structurally modified to increase or decrease air pressure about the first hemisphere, thus providing a ball which curves away from or towards, respectively, the first hemisphere. For example, U.S. Pat. No. 6,354,970 B1 to Reinke et al. discloses a ball having grooves in one hemisphere, wherein the ball curves towards the hemisphere having the grooves. An example of this ball and curving effect is embodied by the Rawlings® Curveball Trainer, a practice ball thrown by a user. As another example of a curving effect, Titleist® discloses a golf ball having dimples on only one hemisphere, wherein the ball curves towards the hemisphere having the dimples (Titleist. "Learning to Fly: Dimples and Golf Ball Design", Retrieved from the internet URL:<http://www.titleist.com/teamtitleist/b/tourblog/archive/2014/12/18/learning-to-fly-dimples-and-golf-ball-design>). Alternatively, the present inventor has also discovered a ball having one hemisphere with grooves that curves away from the hemisphere with grooves, as detailed in the examples taught herein.

In one embodiment, a ball of the invention comprises a structure (e.g. one or more grooves) in a first hemisphere which provides a shorter or more direct air path for at least some of the air passing by the first hemisphere, wherein the first hemisphere experiences increased air pressure. Without being bound by theory, the inventor believes this phenomenon of increased air pressure about the first hemisphere is governed by the same or similar principles which impart increased air pressure under an airplane wing. For example, it is known that airplane wings provide a curved upper side and a relatively straight under side, creating a longer air path on the upper side, thus providing greater air pressure on the lower side of the wing. By analogy, a ball of the invention can have a relatively normally curved second hemisphere (e.g. a perfect hemisphere) and a first hemisphere with structures (e.g. grooves) that allow a shorter path for air to travel.

In one embodiment, the ball of the invention comprises a hemisphere with one or more arcuate grooves that are parallel, substantially parallel, or non-perpendicular to an equator that connects the hemisphere with another hemisphere of the ball. Optionally the one or more arcuate grooves comprise a plurality of arcuate grooves that are parallel or substantially parallel to each other (e.g. where the grooves lie on parallel planes or where imaginary tangents of the groove arcs are parallel). For example, the hemisphere can comprises a plurality of arcuate grooves positioned about respective planes that are parallel to each other and/or parallel to a plane comprising the equator (e.g. concentric grooves or grooves encircling the same center axis). The one or more arcuate grooves can fully or partially encircle the ball. As an example of a groove substantially parallel to the plane comprising the equator, the ball can comprise a spiral or helix groove that arcs around the ball as it becomes more distant from the equator. Examples of useful arcuate grooves are disclosed in U.S. Pat. No. 6,354,970 to Reinke et al. and the examples taught herein. According to the present invention, grooves can be configured, for example, to cause the ball to curve or angle away from the grooved hemisphere (e.g. as detailed in the examples taught herein) or towards the grooved hemisphere (e.g. as detailed in U.S. Pat. No. 6,354,970). The characteristics of the one or more grooves such as shape or depth can govern the curving or angling effect. With the teachings provided herein, the skilled artisan can readily produce a ball having such arcuate grooves without undue experimentation.

In one embodiment, the ball of the invention has a segment removed from an end (e.g. pole) of the ball. The removal of a segment can be configured, for example, to leave, at the end of the ball, any of the following: a flat surface, a concave surface, a convex surface, a flat surface with the peripheral edge thereof beveled to meet a balls spherical surface, a flat annular surface surrounding a convex surface, a recessed surface such as a recessed flat surface, a flat annular surface surrounding a concave surface, or a flat surface across which extends a plurality of parallel grooves such as V-shaped or rectangular shaped grooves. Examples of such a removed segments are disclosed by U.S. Pat. No. 4,128,238 to Newcomb et al. and the examples taught herein. Such a structural feature can optionally be configured to cause the ball to curve away from the hemisphere having the structural feature. Without being bound by theory, the inventor believes that this may be due to the creation of a high pressure zone, for example, due to a shorting if an air path that passes the hemisphere having this structural feature. However, the inventor has also discovered that a segment can be removed from a ball to cause curvature towards the hemisphere having the removed segment. Without being bound by theory, the inventor believes that small variations in structure can sometimes have the opposite curving effect depending on whether the air-path effect or the turbulence effect is greater. Without undue experimentation, the skilled artisan can readily produce such features and configure them for a given ball and/or speed at which the ball is intended to be projected.

In one embodiment, a ball of the invention comprises a structure (e.g. grooves, dimples, facets, or inward or outward bumps or other projections) in a first hemisphere which, relative to the second hemisphere, imparts differential turbulence or vortices and/or differentially modifies local boundary layer separation, for example, to decrease air pressure about the first hemisphere. Such structures are sometimes referred to herein as vortex generators or turbulence generators. Indeed, vortex and turbulence generation has been used on the top side of an airplane and dimples have been used on golf balls to "trip" a turbulent boundary layer and increase airspeed (Aerospaceweb, "Vortex Generators", Retrieved from the internet URL:<http://www.aerospaceweb.org/question/aerodynamics/q0009.shtml>; Aerospaceweb, "Golf Ball Dimples & Drag", Retrieved from the internet URL:<http://www.aerospaceweb.org/question/aerodynamics/q0215.shtml; and Titleist. "Learning to Fly: Dimples and Golf Ball Design", Retrieved from the internet URL:<http://www.titleist.com/teamtitleist/b/tourblog/archive/2014/12/18/learning-to-fly-dimples-and-golf-ball-design>). For example, Titleist® discloses a golf ball having dimples on only one hemisphere, wherein the ball curves towards the hemisphere having the dimples (Titleist. "Learning to Fly: Dimples and Golf Ball Design", Retrieved from the internet URL:<http://www.titleist.com/teamtitleist/b/tourblog/archive/2014/12/18/learning-to-fly-dimples-and-golf-ball-design). With regards to vortex generators or turbulence generators such as dimples, it is known to golf ball manufactures that slight deviations in dimples configuration (e.g. surface density, depth, area, and/or shape) can cause drastic changes in aerodynamics. However, many different dimple (and other generator) configurations are known in the golf ball manufacturing field to create a positive impact on turbulent boundary layer and aerodynamics (e.g. to increase flight distance). Accordingly, with the teachings provided herein, one skilled in the art can, without undue experimentation, readily create vortex generators or turbulence generators to modulate the air pressure difference of two hemispheres of a ball of the invention. An interesting disclosure is that of U.S. Pat. No. 6,354,970 B1 to Reinke et al., discloses a ball having grooves in one hemisphere, wherein the ball curves towards the hemisphere having the grooves. Without being bound by theory, the present inventor believes that, while these grooves may indeed create a shorter air path, which would otherwise contribute to an increase in pressure on the grooved side, the ball of Reinke et al. actually curves towards the grooved hemisphere, presumably due to a more dominant reduction air pressure force created by this particular groove configuration, for example, by the tripping of a turbulent boundary layer. Which effect dominates (e.g. air path distance vs turbulence) can sometimes be governed by the speed the ball is projected. Accordingly, a ball of the invention can be configured to be projected at, e.g. 50-70 mph such as 60 mph when determining which effect will dominate.

In one embodiment, a ball of the invention comprises a first hemisphere comprising a vortex or turbulence generator (e.g. dimples) which induces or contributes to in-flight ball curvature towards the first hemisphere and further comprises a second hemisphere a structure (e.g. grooves) which induces or contributes to in-flight ball curvature or lateral trajectory away from the second hemisphere (e.g. grooves). An example of such is detailed in the examples taught herein.

In one embodiment, the ball comprises a hemisphere having a plurality of grooves extending away from an equator that joins the hemisphere with another hemisphere of the ball. Optionally, the ball comprises an arcuate groove positioned coincident with the equator (e.g. a generally equatorial-circumferentially-extending groove). An example of such a structural feature is disclosed in US 2007/0155549 to Keker. Such a structure can be configured to impart curvature towards the hemisphere having the plurality of grooves extending away from an equator. Without being bound by theory, the inventor believes that this effect may be due the action of these grooves as vortex or turbulence generators.

In one embodiment, a ball of the invention comprises a structure, that when oriented laterally to one side of a pitching drive wheel, is projected from the drive wheel with a projection angle offset relative to a normal projection angle (i.e. perpendicular to the axis of rotation of a drive wheel). For example, a first hemisphere can have one or more wheel-interfacing members (e.g. ridge or other projection) that, due to its asymmetrical lateral orientation, cause the ball to be projected at an angle. Without being bound by theory, it is believed that while a drive wheel spins in a direction perpendicular to its axis (thus providing a perpendicular force), the angle of interface or attack on the interfacing members can be configured to be non-perpendicular and causes an angled trajectory of the ball.

Optionally, when projected from a pitching machine at 60 mph (as it departs from a drive wheel) or projected from a from a pitching machine having been set to a setting configured to project a ball at 60 pmh, and the pitching machine being oriented horizontally, the ball travels a lateral distance (e.g. sideways distance or distance measured on a line perpendicular to a normal straight trajectory or distance measured on a line coincident with the axis of rotation of the drive wheel) of at least 3 inches or at least 6 inches relative to center (i.e. relative to a straight-traveling ball not modified according to the present invention), upon having traveled 40 feet horizontally from the pitching machine. For example, the ball can be configured to travel a lateral distance of about 3 inches to about 15 inches (e.g. about 3 inches to about 10 inches, about 6 inches to about 15 inches, or about 6 inches to about 10 inches) upon traveling longitudinally 40 feet Optionally, the pitching used to provide such lateral movement is the Jugs® M1200 set on 60 mph and having an appropriately sized ball-loading chute and an appropriately-spaced pinch pad (i.e. configured for the diameter of the ball).

Control of Vertical Trajectory

A ball of the invention optionally comprises a structural feature which controls vertical trajectory of the ball ('height-controlling structure'). This height-controlling structure is configured to, when differentially oriented to interface the drive wheel in a dominant or weaker manner, dictate the vertical component of the ball's trajectory when the ball is projected from the drive wheel. This structural feature is provided by a first portion of the ball surface imparting increased or decreased traction or grip to the ball-wheel interface and/or a ball-pinch plate interface (e.g. as detailed in Example 3), relative to a second portion of the ball surface. Accordingly, a ball of the invention optionally comprises a surface with a plurality of portions exhibiting different traction on a drive wheel.

The Magnus effect is an effect in which a spinning ball curves away from its flight path due to the rotation of the ball. The Magnus effect imparts force on the ball which is perpendicular to both the flight path and the axis of rotation. Under the Magnus effect, backspin imparts an upward force (opposite that of gravity) on a moving ball, while topspin produces a downward force (in the same direction as gravity). Standard pitching machines optionally have a single drive wheel that spins on a horizontal axis and creates backspin on ball projected from the top of the wheel. The amount of upward force imparted by the Magnus effect is governed by the speed (RPM) at which the ball spins as it is projected from the drive wheel. Therefore, at a fixed air speed, whether the ball actually rises from the Magnus effect (or the extent thereof), or merely experiences less of a drop due to gravity (or the extent thereof), can also be governed by the rate of backspin imparted by the drive wheel and the weight of the ball.

The present inventor has discovered that the rate of spin imparted on a ball when being projected by a pitching machine having a drive wheel can be manipulated by changing the traction of the ball-wheel interface and/or a ball-pinch plate interface. The present inventor further discovered that a ball having a plurality portions (e.g. first and second hemispheres) exhibiting different traction can be propelled with different rates of spin, depending on which of the plurality of ball portions dominates the ball-wheel interaction (and/or ball-pinch plate interaction) as the ball is propelled from the wheel. Accordingly, a ball having a height-controlling structure can be projected from a pitching machine to provide at least two modes of projection, namely, a high ball (e.g. with greater backspin) and a low ball (e.g. with less backspin). These modes can be, for example, differentiated by whether the height-controlling structure dominates the ball-wheel interface when being projected form the pitching machine. The terms high ball and low ball, as they relate to height, relate to the relative height of the ball after it has been projected a distance (e.g. 30-80 feet) from the pitching machine in the high ball and low ball modes.

Figure 3A:
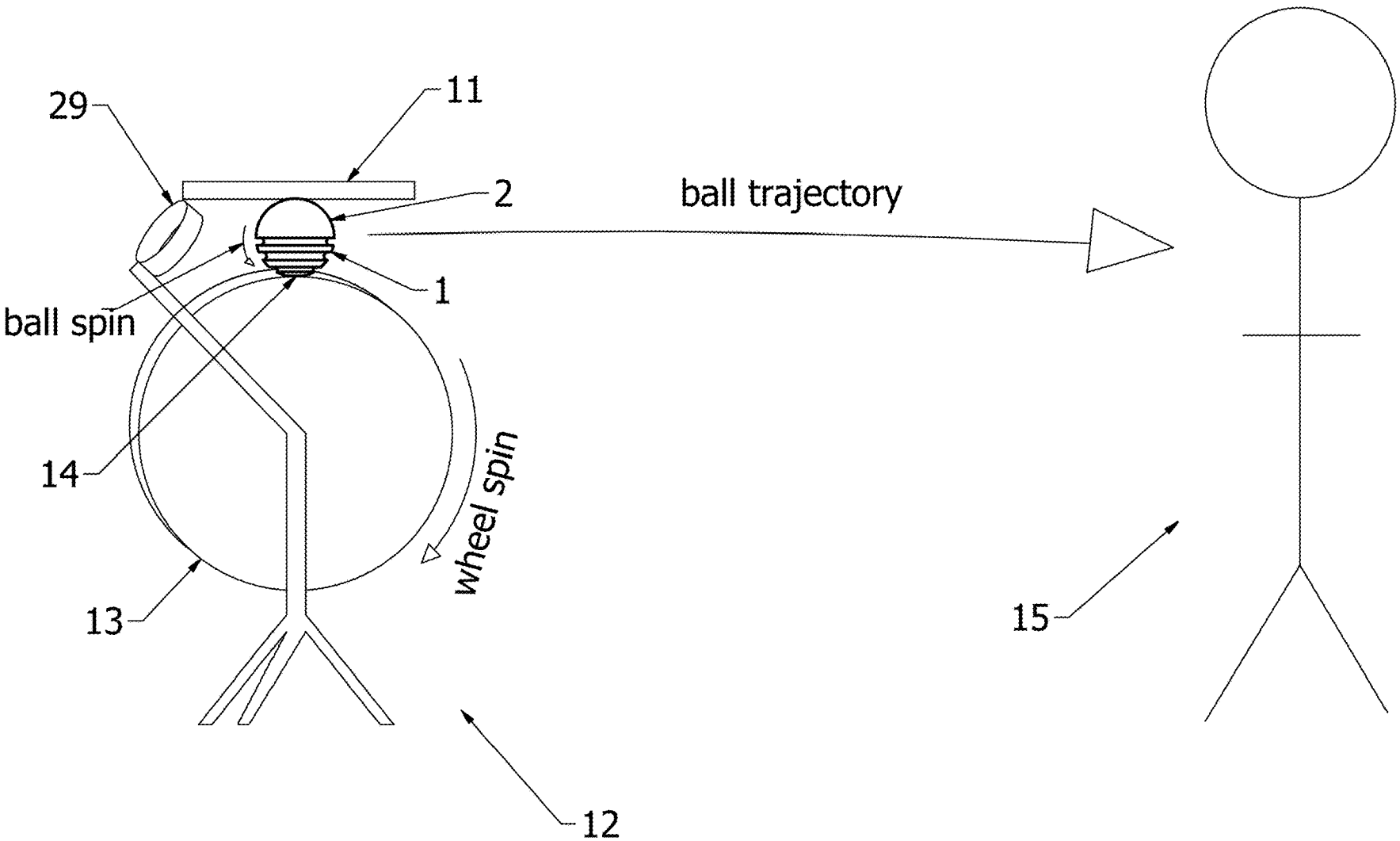
FIGS. 3A and 3B depict the same ball projected from a pitching machine with different vertical trajectories.
Figure 3B:
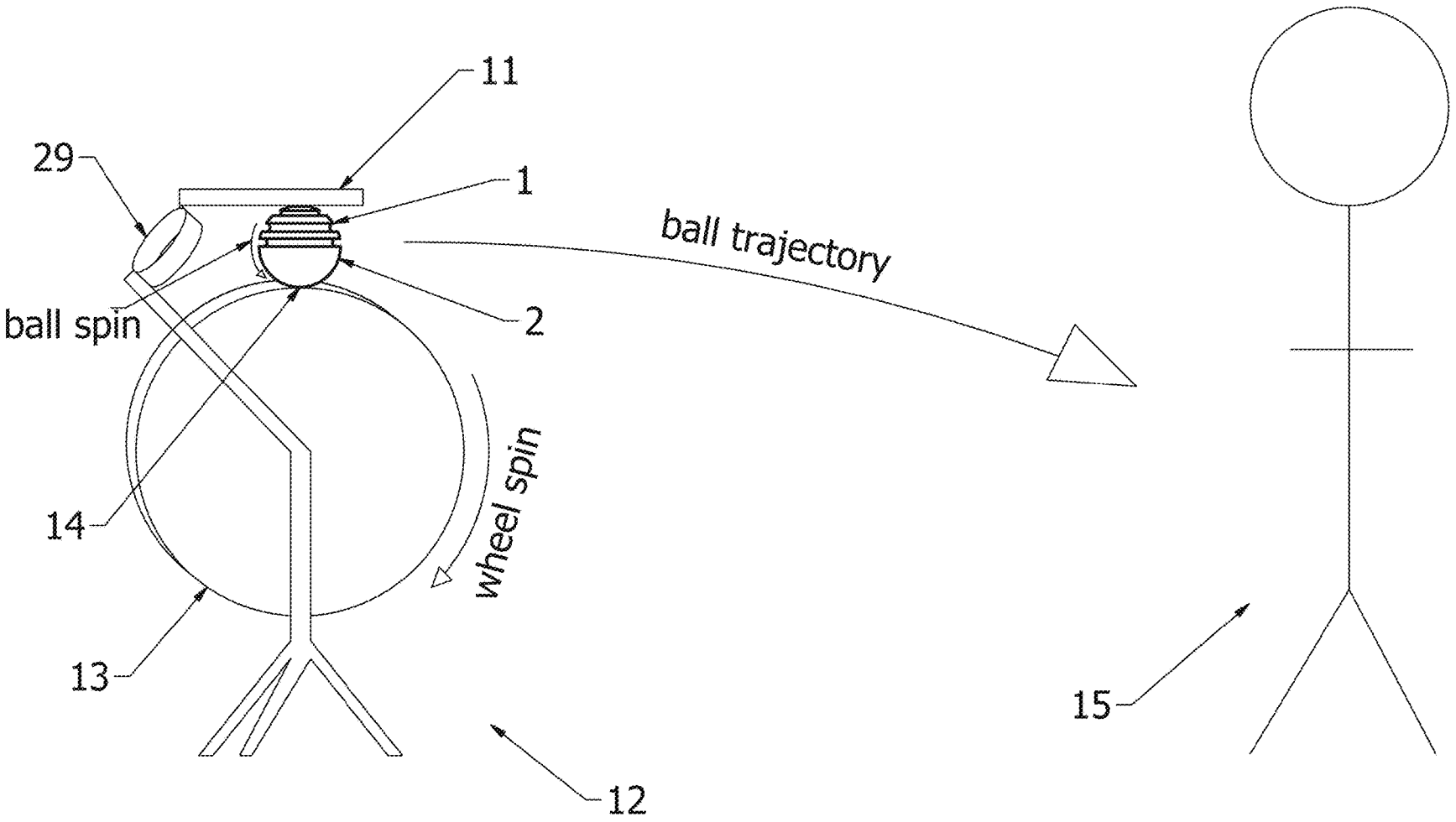

Optionally, a ball of the invention can be projected from a pitching machine in a high ball mode (e.g. as shown in FIG. 3A) and a low ball mode (e.g. as shown in FIG. 3B), wherein when projected from a pitching machine at 60 mph (as it departs from a drive wheel) or projected from a from a pitching machine having been set to project a ball at 60 pmh, wherein the pitching machine is oriented horizontally, the height difference of the ball is, upon having traveled 40 feet horizontally from the pitching machine, at least 10 inches when comparing the ball projected in the high ball mode to the ball projected in the low ball mode. Optionally, the height difference is about 10 inches to about 50 inches. Optionally, the pitching used to provide such a height difference is the Jugs® M1200 set on 60 mph and having an appropriately sized ball-loading chute and an appropriately-spaced pinch pad (i.e. configured for the diameter of the ball). The difference in height between the high ball mode and the low ball mode can be tailored by changing the relative amount of traction (e.g. groove depth) of the two hemispheres and/or changing the relative mass of the two hemispheres.

Optionally, a ball of the invention can be projected from a pitching machine in a high ball mode and a low ball mode, wherein the drop of the ball of the invention in the low mode is greater than that of a comparator ball having uniform weight and shape (e.g. as detailed in Example 9). Optionally, the hemisphere exhibiting increased traction has a different mass than the hemisphere exhibiting decreased traction (e.g. where differential traction is imparted by removal or addition of material relative to the comparator ball). Such a ball optionally exhibits wobble when spinning about an axis that is coincident with an equator that joins the two hemispheres. Additionally or alternatively, this increase in drop can optionally be attributed to the hemisphere exhibiting increased traction providing more grip to interface a pinch plate of a pitching machine, and thereby cause slippage at the wheel-ball interface (on the opposing side of the ball) to reduce backspin and thereby reduce drop-reducing Magnus effect.

The plurality of ball surface portions with different traction can be provided in any manner such that the portions exhibit different grip or friction at the ball-wheel interface and/or at a ball-pinch plate interface. Traction can be tailored with or without a relative change in material composition of the ball's surface at the different portions. By example, the traction may be tailored by configuring the shape of the surface alone or by a change in surface composition (e.g. surface material). For example, traction can be tailored using inward projections such as cavities (e.g. dimples) or tread (e.g. grooves) or outward projections such as outward ridges. Additionally or alternatively, traction can be tailored using a change in surface composition, e.g. a frictional coating (e.g. an elastomer such as rubber or a tack surface or adhesive) or a lubricating coating (e.g. solid such as non-stick coating such as polytetrafluoroetheylene (PTFE) or other non-stick organic polymer, silicon dioxide or other inorganic non-stick material, or a liquid such an oil).

While the invention contemplates balls with any means of providing portions (e.g. hemispheres) with different traction, the present inventor has discovered that traction can be modified by surface shape (e.g. by providing grooves or other traction-imparting surface shapes), even without a differential use of surface materials. This embodiment provides an advantage of having less manufacturing cost of goods (e.g. producible from a mold or a single material), production time (e.g. requiring a reduced number of material types), or production complexity (e.g. being easily sourced to a manufacturer).

Optionally, a hemisphere of a ball can have its surface shape modified to increase or decrease traction. The selection of surface shape and effect on traction can optionally be dependent on physical properties of the ball such as hardness or compressibility. For example, optionally depending upon the ball's weight, the surface of a ball that is extremely hard or non-compressible (e.g. hard plastic balls like a Wiffle ball) may have its traction decreased by the modification with grooves due to the removal of drive wheel-contacting surface. However, the present inventor has surprisingly discovered that the surface of balls having a lower hardness or greater compressibility can have its traction increased by the modification of grooves, which can act as teeth to be gripped by a drive wheel. Further, a ball with extremely low hardness or extremely high compressibility (e.g. the Rawlings® Curveball Trainer or Easton EZ Curve®) can be so "squishy" that surface shape has no effect on traction with a wheel. Accordingly, with the teachings provided herein, and without undue experimentation, the skilled artisan can readily produce a ball having hemispheres or portions with different spin-inducing traction by tailoring hardness, weight or density, and surface shape (or other traction imparting structure).

Further, while the invention contemplates balls having a different means of controlling vertical trajectory than the means of controlling horizontal trajectory, the present inventor has discovered that a surface shape (e.g. grooves) can be used to control both the vertical trajectory and the horizontal trajectory. This embodiment provides an advantage of having less manufacturing cost and complexity and enhancing user-friendliness of the ball of the invention. For example, providing a single feature that controls vertical trajectory and the horizontal trajectory shortens user training time and reduces user error when using the ball (e.g. regarding how to orient the ball about a pitching machine to obtain the desired pitch trajectory).

Other Features

Drag-Reducing Surface

In one embodiment, a ball of the invention comprises a drag-reducing surface. For example, the ball can comprise a plurality of dimples or facets. While such a surface can be imparted asymmetrically to modulate horizontal trajectory (e.g. through curvature-inducing turbulence) or vertical trajectory (e.g. through modulated spin-inducing traction) as taught herein, such a surface can additionally or alternatively be configured to reduce drag and increase projection distance and/or velocity, especially nearing the end of the ball's flight. In other words, a ball can be configured with less drag to undergo less deceleration in-flight.

The mechanism of drag reduction by surface modification is well-known (Choi et al., "Mechanism of drag reduction by dimples on a sphere", Phys. Fluids 18, 041702, 2006, Retrieved online from the URL<http://biosport.ucdavis.edu/lab-meetings/Choi%20et%20al%20-%202006%20%20-Mechanism%20of%20drag%20reduction%20by%20dimples%20on%20a%20sphere.pdf>).

Optionally, the surface of a ball of the invention comprises a plurality of dimples configured to interrupt laminar air flow over the surface of the ball in flight and induce turbulent air flow. The result of this induced turbulence is reduced drag on the ball, which allows the ball to decelerate slower and be projected with greater precision. Optionally, the dimples are provided in a regular pattern. Optionally, the dimples are semi-spherical in shape. Optionally, the dimples have a diameter or width between 0.10 and 0.5 inches. Optionally, the dimples have a depth of between about 0.03 and 0.1 inches. Optionally, the dimples have a radius of curvature of between 0.02 and 0.15 inches. Optionally, the ratio of the diameter of the ball to the diameter of the dimples is between about 10:1 and 50:1 (e.g. between about 20:1 and 40:1).

Physical Properties

A ball of the invention can be made of any material and can have any density, compressibility, hardness, or size.

While the invention is not limited to any particular configuration, the trajectory of a ball of the invention, when projected from a pitching machine, is highly governed by its physical characteristics. For example, the ball disclosed by U.S. Pat. No. 6,354,970 B1 to Reinke et al. and embodied by the Rawlings® Curveball Trainer (Baseballexpress. "Rawlings Curve Ball Hit Training Set (6 Pack)", Retrieved online from the URL<http://www.baseballexpress.com/catalog/product.jsp?productId=119936>.), fails to produce a satisfactory trajectory when projected from a pitching machine, as detailed in the Examples taught herein. For any ball to be sufficiently projected from a pitching machine wheel, it must have a sufficient weight and hardness or compressibility. However, it has been discovered that, for a ball of the invention having a controllable trajectory, a ball's physical properties (e.g. weight, density, hardness) can be tailored to allow proper interaction with the drive wheel to control the balls trajectory.

A ball with a vertical trajectory can be configured with a sufficient hardness to allow the first and second hemispheres (one of which is specialized to impart greater grip on the wheel) to exhibit differential grip on the wheel. For example, a ball that is too conformable or "spongy" may exhibit so much grip on the drive wheel, that the difference in grip on the wheel from the first and second hemispheres is insufficient to cause a relative difference in spin rate that is great enough to impart a user's desired difference in vertical trajectory when the first and second hemispheres are placed side up or side down on the drive wheel. Further, such squishy balls may not experience sufficient force by a pinch plate to be gripped and projected satisfactorily by the drive wheel. A skilled artisan may tailor hardness to their choosing to provide controlled trajectories according to the present invention, and with the teachings provided herein, will understand that in certain configurations, they may tailor hardness according to the size of the ball or the selection of surface configuration used to impart differential vertical trajectory.

Hardness and Compressibility

Optionally, a ball of the invention is configured with a particular compressibility. Compressibility is the deflection that a ball undergoes when subjected to a compressive load. Compression can be expressed as the force required to compress the ball 0.25 inches. For example, a ball of the invention can optionally have a compressibility of less than about 250 lbs/0.25 in, less than about 200 lbs/0.25 in, less than about 150 lbs/0.25 in, or less than about 150 lbs/0.25 in. By comparison, official baseball and softball game balls have compressibility exceeding 250 lbs/0.25 in. Optionally, a ball of the invention has a compressibility of greater than 5 lbs/0.25 in, for example, greater than 5 lbs/0.25 in and less than any of about 250 lbs/0.25 in, about 200 lbs/0.25 in, about 150 lbs/0.25 in, or about 100 lbs/0.25 in. Optionally, a ball of the invention has a compressibility of greater than 10 lbs/0.25 in, for example, greater than 10 lbs/0.25 in and less than any of about 250 lbs/0.25 in, about 200 lbs/0.25 in, about 150 lbs/0.25 in, or about 100 lbs/0.25 in. Optionally, a ball of the invention has a compressibility of greater than 15 lbs/0.25 in, for example, greater than 15 lbs/0.25 in and less than any of about 250 lbs/0.25 in, about 200 lbs/0.25 in, about 150 lbs/0.25 in, or about 100 lbs/0.25 in. Competition baseballs and softballs are typically characterized by the applied weight required to compress the ball 0.25 inches. While balls of the invention can optionally be substantially more compressible than these competition balls, the compressibility can be measured using the same technique which is well-known.

Optionally, a ball of the invention is configured with a particular hardness. Hardness can be measured by the A-2 Shore durometer scale. Optionally, a ball of the invention has a hardness of at least about 50, for example between about 50 and 100, for example from about 50 and to about 90, from about 60 to about 90, or from about 70 to about 90.

The modification of a ball's surface (e.g. with grooves) can affect the measured values of hardness and compressibility when the measuring tool interacts with the ball at a location in which it is modified (e.g. a ball can be more compressible at a groove). Accordingly, when a ball of the invention has a surface shape is modified (e.g. relative to a perfect sphere), the hardness and compressibility can optionally be measured using a comparator ball not having its surface shape modified but being made of the same composition. Alternatively, the hardness and compressibility can be measured on the ball directly. Thus, the invention contemplates balls having hardness and compressibility taught herein values as measured according to the composition (e.g. material) of the ball itself (i.e. measured using an unmodified comparator ball having the same composition). Further, the invention also invention contemplates alternatively balls having hardness and compressibility taught herein values as measured directly using the ball of the invention.

Density

A ball of the invention can have any density.

Generally, a ball having controllable horizontal trajectory by curving will exhibit less curvature as the density of the ball increase. Accordingly, prior art balls having curve-inducing features have been specifically engineered to have a low density (e.g. about 0.1 g/cm$^3$). However, as taught herein, a ball of the invention is optionally provided as a pitching machine ball having a sufficient weight to be satisfactorily projected from a pitching machine. Surprisingly, such denser balls, when provided with a structure for controlling horizontal trajectory based on in-flight curvature and/or projection angle, can still provide sufficient lateral movement when projected by a pitching machine. While the amount of curvature is reduced as density increases, the precision of a pitching machine, lacked by an average human thrower, can capitalize on even the smallest amount of curvature, as detailed in the examples taught herein. In contrast, the relatively low precision of an average human thrower can ultimately lead to a scenario where the lack of throwing precision accounts for greater deviation in lateral trajectory than curvature imparted by ball structure. Thus, denser curving balls are not only absent in the prior art curving balls, but are contraindicated.

Optionally, ball has a density of at least about 0.2 grams per cubic centimeter (g/cm$^3$). Optionally, ball has a density of at least about 0.3 g/cm$^3$. Optionally, the ball has a density of about 0.2 g/cm$^3$ to about 1.3 g/cm$^3$, about 0.2 g/cm$^3$ to about 1 g/cm$^3$, about 0.2 g/cm$^3$ to about 0.8 g/cm$^3$, about 0.2 g/cm$^3$ to about 0.7 g/cm$^3$, or about 0.3 g/cm$^3$ to about 0.9 g/cm$^3$.

According to the present invention the density can be measured with respect to the volume displaced by the ball. In other words, if the ball has a hollow core surrounded by layer, the void volume of the hollow core is not subtracted from the volume displaced by the ball to determine density.

Size

A ball of the invention can be any size.

Optionally, the ball has a circumference of about 9 inches to about 16 inches. For example, optionally, the ball has circumference of any of about 9 inches, about 10 inches, about 11 inches, or about 12 inches.

The size of the ball can be measured without considering any cutouts (e.g. grooves or dimples) or projections extending therefrom. In other words, the size of the ball can be measured with respect to the size of a sphere from which the ball is based on before modification (regardless of whether the modification be in the form of molding or assembly).

Materials

A ball of the invention can be made of any material.

Optionally, the ball is made from a polymeric foam such as a polyurethane.

Optionally, the ball uniform density throughout its cross-section.

Optionally, the ball is made from a mold. Optionally, the entirety of the ball or a hemisphere thereof is made from a mold.

Optionally, the ball comprises a resilient polyurethane foam sphere of homogeneous composition and density throughout its cross section.

Optionally, the ball comprises a homogeneous elastomeric material, so that the body has a constant density and hardness (e.g. durometer) throughout.

Optionally, the ball has a non-perforated outer surface. This configuration distinguishes such a ball from wiffle-type balls.

Methods

In one embodiment, the invention provides a method comprising using a ball of the invention in conjunction with a pitching machine configured to project the ball.

Optionally, ball comprises a height-controlling structure and the method comprises orienting the sports ball on a drive wheel of the pitching machine such that the drive wheel-ball projecting interaction is dominated by a first hemisphere having a relatively more tractive surface compared to a second hemisphere, whereby the sports ball is projected with a rate of spin greater than when the sports ball is oriented on the drive wheel such that the drive wheel-ball projecting interaction is dominated by a second hemisphere.

Typical drive wheels produce back spin on the ball. Under this scenario, the ball, when projected with a greater spin, will have a higher trajectory relative to the ball when projected with less spin. The dominating interaction is the wheel-ball interaction which dictates how much spin is produced. For example, the dominating wheel-ball interaction can be the on-wheel interaction provided by last portion of the ball to contact the wheel and/or the portion of the ball that has the longest cumulative contact time with the wheel. For example, depending on the location at which the ball first makes contact with the drive wheel, the ball may rotate one or more times while in contact with the drive wheel before disengaging from the drive wheel to begin its in-flight trajectory. Thus, a user, with only a few test pitches, can quickly compare loading positions and determine how to orient the ball to provide the tractive surface as the dominating wheel-ball interaction.

Optionally, the ball comprises a lateral trajectory-controlling structure and two hemispheres which experience different air pressure when in-flight, and the method comprising orienting the sports ball to offset one of the hemispheres laterally to a first side a center plane of a drive wheel of the pitching machine, whereby the ball of the invention is projected about a trajectory offset laterally relative to when the sports ball is oriented to offset the hemisphere laterally to a second side a center plane of the drive wheel.

EXAMPLES

Example 1 Ball of the Invention

FIG. 1A depicts a useful ball of the invention. The ball comprises a first hemisphere 1 and a second hemisphere 2. The first hemisphere 1 comprises a plurality (e.g. 3) of arcuate grooves 3 positioned about respective planes that are parallel to each other and parallel to a plane comprising the equator that joins the first hemisphere 1 and the second hemisphere 2. It is noted that, unless specifically stated, the terms plane, equator, axis, and pole are imaginary reference geometries and are not meant to indicate that the ball includes an additional structure providing the geometry.

Figure 1F:
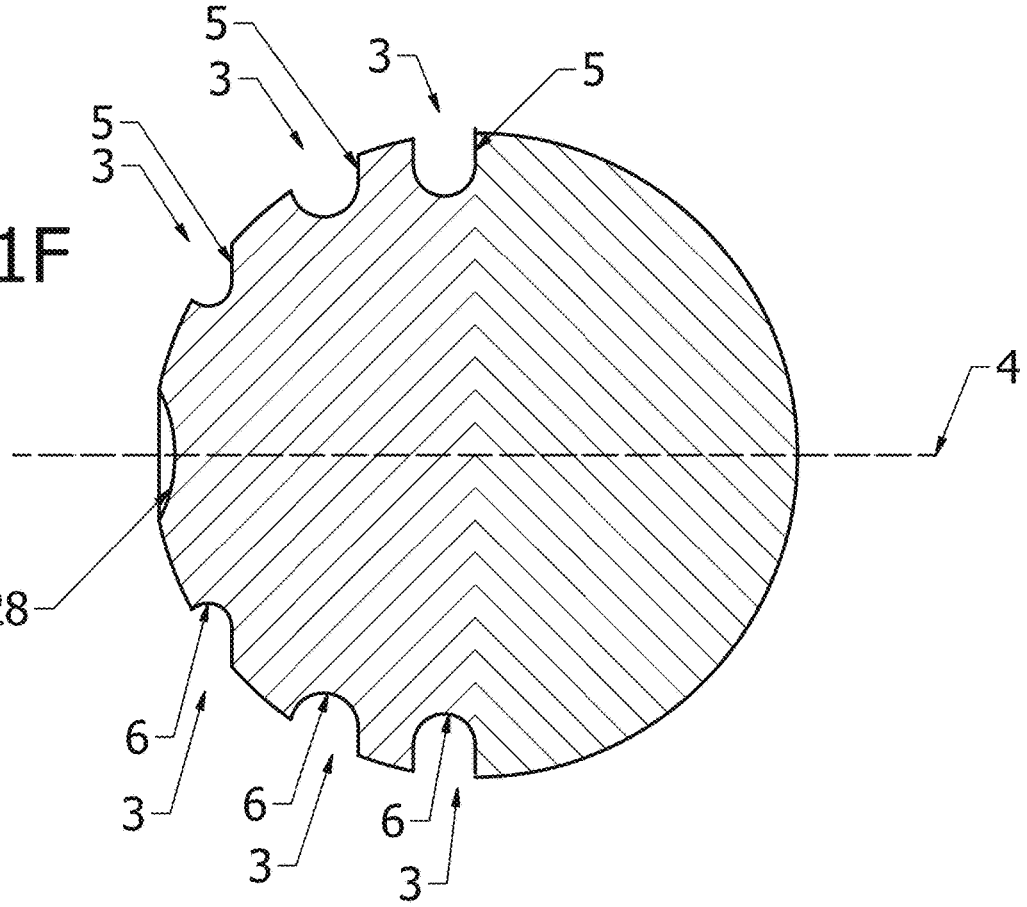
Figure 1G:
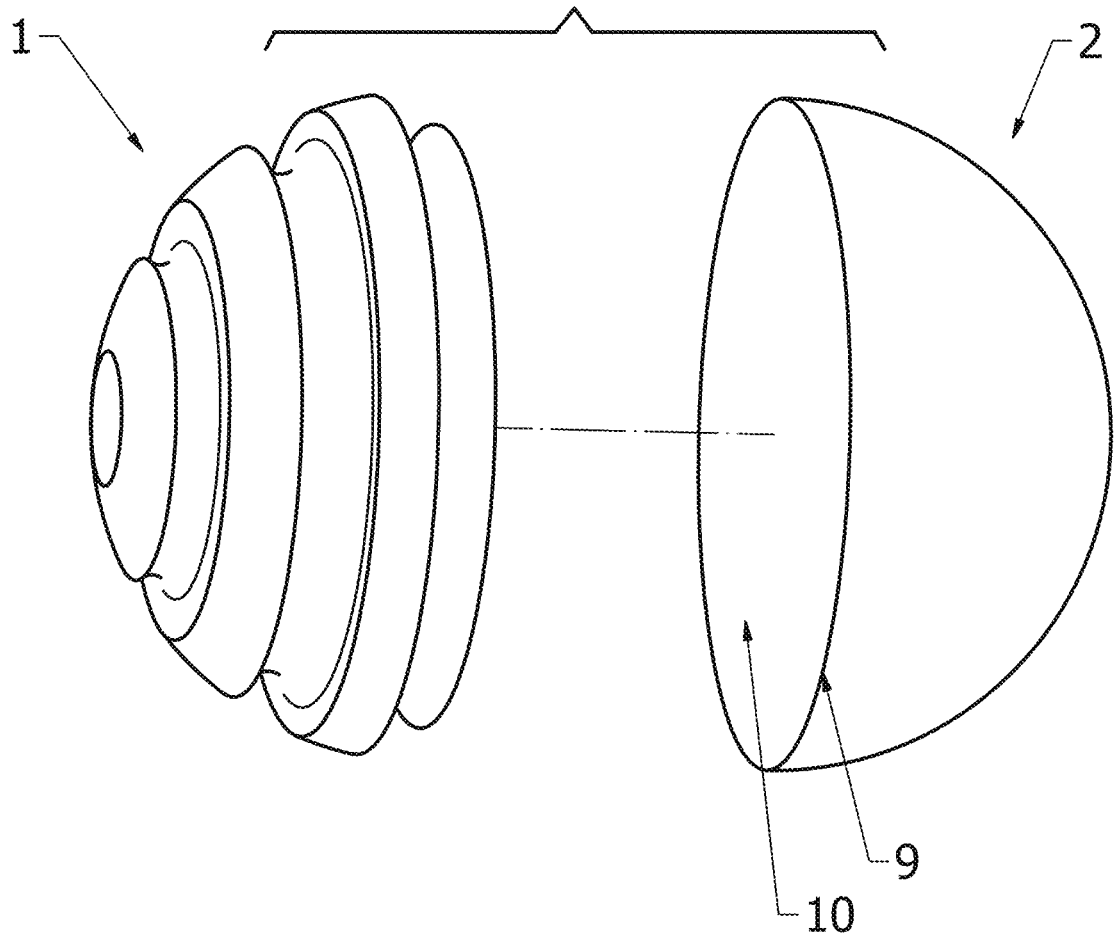
Figure 2:
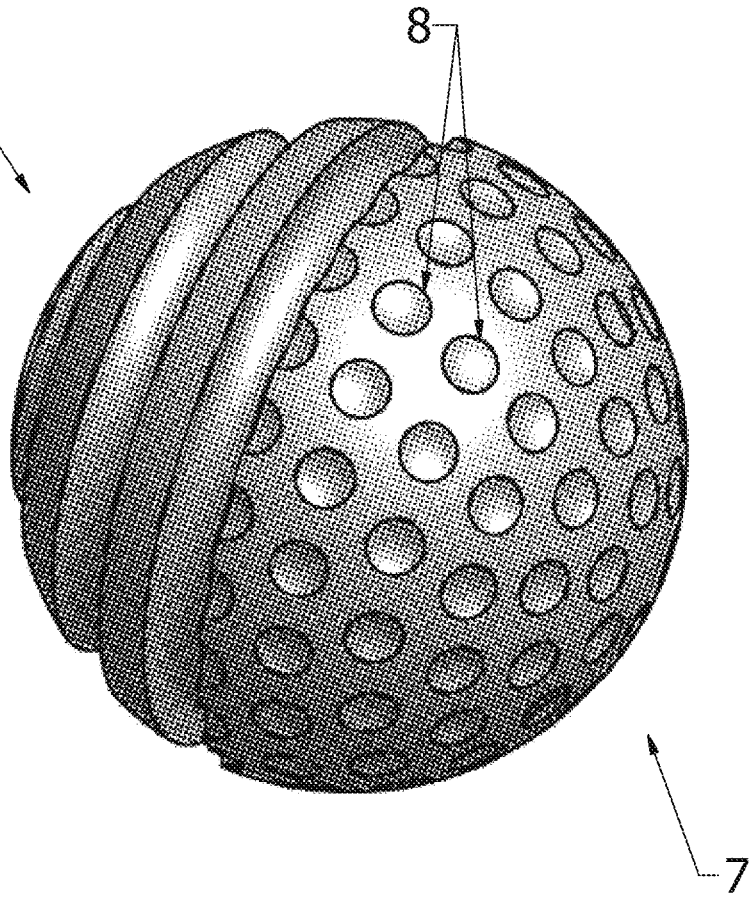
FIG. 2 depicts a ball of the invention.

Each of the arcuate grooves 3 completely surround the ball, as shown in FIG. 10, and have a "U" shape, as shown in FIG. 1F.

The ball further comprises a cut segment 28 having a concave surface.

The ball can comprise an unmodified (e.g. purely hemispherical) second hemisphere 2 as shown in FIG. 1, or it can comprise a second hemisphere 7 having a plurality of dimples 8 or other vortex or turbulence generators.

The grooves of the first hemisphere 1 impart first hemisphere 1 with greater traction on the drive wheel of a pitching machine relative to the second hemisphere 2 and relative to second hemisphere 7. Thus, the ball can be differentially loaded in a pitching machine to impart different amounts of spin to the ball when projected from the pitching machine and thereby control the vertical trajectory, e.g. as detailed in the following example.

The grooves of the first hemisphere 1, when projected in a direction coincident with a plane that connects the first hemisphere 1 and the second hemisphere 2 or 7 (i.e. spinning on an axis that connects the pole of hemisphere 1 with the pole of hemisphere 2 or 7) are configured to induce a high pressure zone about the first hemisphere 1 relative to second hemisphere 2 or second hemisphere 7. Thus, the ball can be differentially loaded (e.g. with hemisphere 1 to the right or the left) in a pitching machine to control the horizontal trajectory of the ball.

Example 2 Method of Projecting a Ball of the Invention with Controlled Horizontal Trajectory A ball of the invention comprising a horizontal trajectory controlling structure can be projected from a pitching machine, wherein the user can control horizontal trajectory, e.g. depending upon how the structure is oriented when the ball is loaded in a pitching machine.

Figure 4:
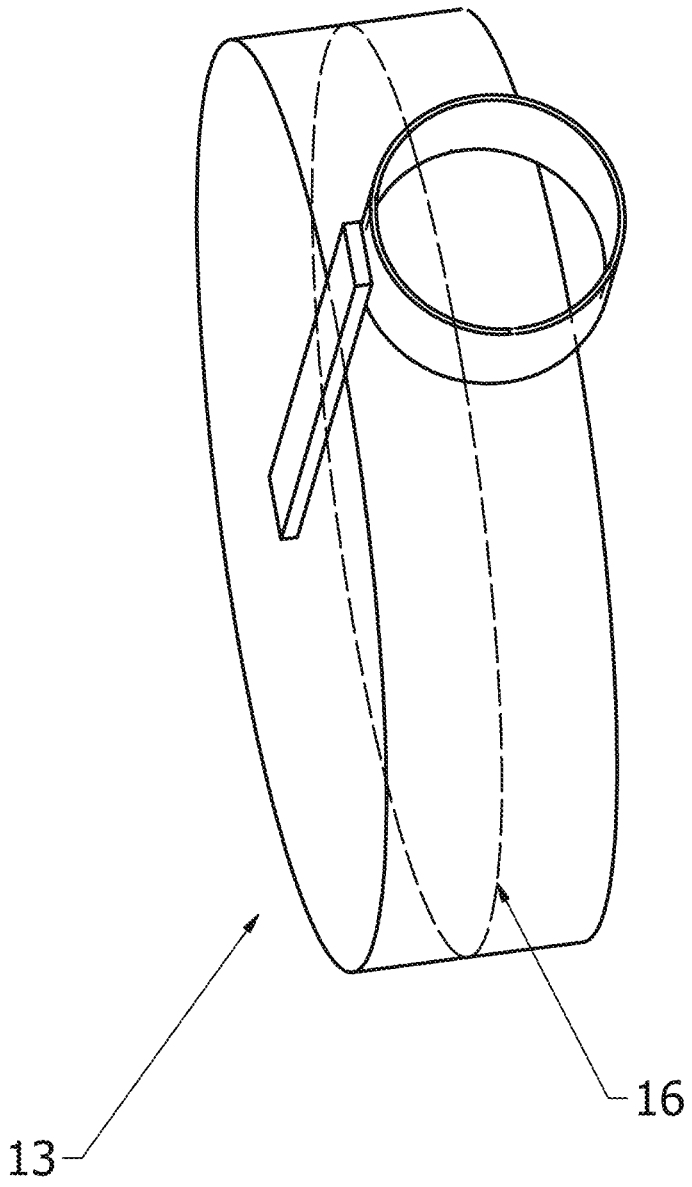
FIG. 4 depicts a pitching machine drive wheel and imaginary center plane thereof.

As shown in FIG. 4, a pitching machine can have a drive wheel 13 that spins about an axis to generate a projecting force. For reference, the drive wheel can be imagined as having a center plane 16.

Figure 5A:
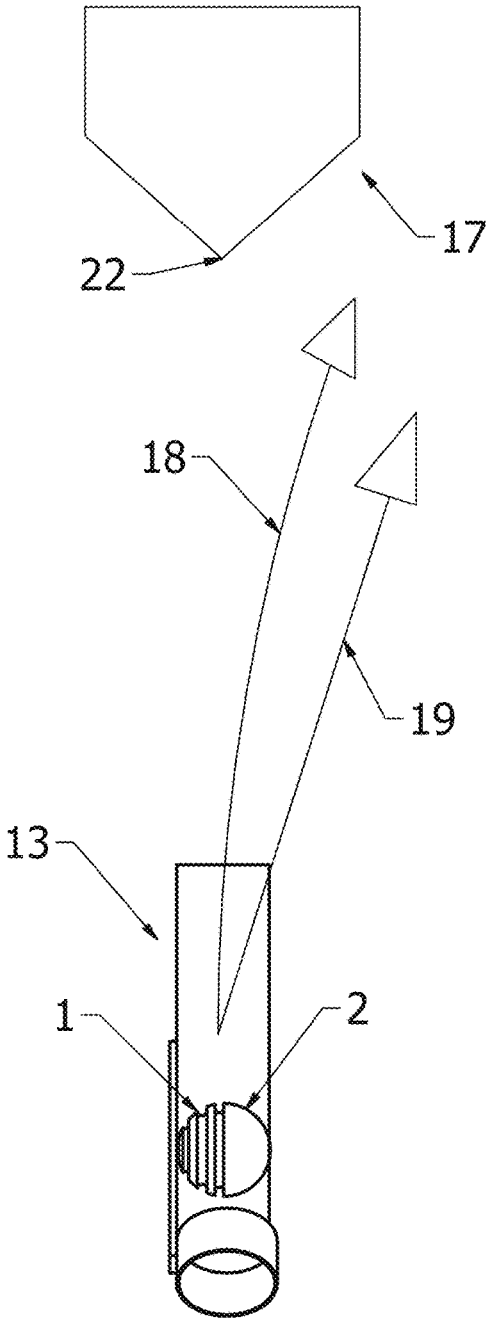
FIGS. 5A and 5B depict the same ball projected from a pitching machine with different horizontal trajectories.
Figure 5B:
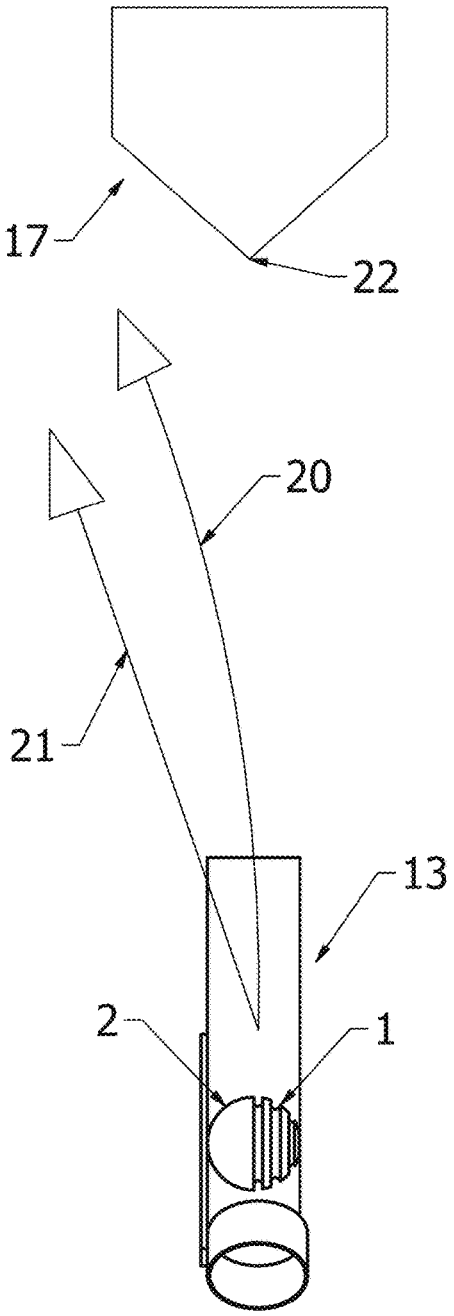

As detailed in FIG. 5A and FIG. 5B, depending upon how the ball is oriented, the pitching machine will project the ball with a trajectory that is offset laterally to one side (e.g. right, FIG. 5A) or another (e.g. left, FIG. 5B). Specifically, the ball, e.g. as detailed in Example 1, can be loaded such that the plane connecting hemisphere 1 and hemisphere 2 is aligned with the center plane 16 of the drive wheel 13, as shown in FIGS. 5A and 5B. Such alignment can occur with hemisphere 1, having a plurality of arcuate grooves, to be aligned to the left (FIG. 5A) or right (FIG. 5B). An alternative manner to describe this orientation is the axis of rotation of the ball is the axis which connects the hemispheres 1,2 and the axis of rotation of the ball is aligned with the axis of ration of the drive wheel.

A typical ball (e.g. comparator ball constructed from the same materials as the present ball but not surface-modified), when projected from the drive wheel 13 of a pitching machine, will assume a trajectory that is straight, e.g. will travel across the apex 22 of home plate 17 next to which a batter stands. However, upon projection from the drive wheel 13 of the pitching machine, a ball of the invention, when oriented as described above, will assume a trajectory offset laterally. As depicted in FIGS. 5A and 5B, the offset trajectory can occur in the form of a curved trajectory 18,20 or in the form of an angled projection trajectory 19,21, as taught herein. Further, while FIGS. 5A and 5B depict the ball assuming a trajectory that curves away from the grooved side, the invention also contemplates structural features that cause curvature towards the side having the horizontal trajectory-controlling structure, as taught herein.

Example 3 Method of Projecting a Ball of the Invention with Controlled Vertical Trajectory A ball of the invention comprising a height-controlling structure can be projected from a pitching machine, whereby the user can control vertical trajectory, e.g. depending upon how the structure is oriented when the ball is loaded in a pitching machine. A hemisphere of the ball can comprise a height-controlling structure that increases or decreases traction, thus providing a ball having two hemispheres which exhibit different traction on the drive wheel of a pitching machine.

FIGS. 3A and 3B depict an example setup to practice a method of the invention. A pitching machine 12 is provided, distanced from a target, e.g. near batter 15. The pitching machine comprises a drive wheel 13, a chute 29 for loading a pitching machine ball, and a pinch plate 11 that is spaced from the wheel 13 such that the ball is slightly pinched or forced against the wheel 13 to cause the wheel 13 to project the ball. As detailed in FIG. 3A and FIG. 3B, depending upon how the ball is oriented, the pitching machine will project the ball with a trajectory that is relatively high (FIG. 3A) or relatively low (FIG. 3B). Specifically, the ball, e.g. as detailed in Example 1, can be loaded such that the interaction of the drive wheel and the ball ('drive wheel-ball projecting interaction') is dominated by the hemisphere 1 having a more tractive surface, whereby the ball is projected with a rate of spin greater than when the sports ball is oriented on the drive wheel such that the drive wheel-ball projecting interaction is dominated by the hemisphere 2 having the less tractive surface. Additionally or alternatively, the difference in spin rates between the high mode (FIG. 3A) and low mode (FIG. 3B) can influenced by the difference in interaction and traction of the hemispheres 1,2 with the pinch plate 11. In the depicted pitching machine 12, when one hemisphere (e.g. a more tractive hemisphere) is interfacing the drive wheel 13, the opposite hemisphere (e.g. a less tractive hemisphere) is interfacing the pinch plate 11. Thus, increased traction of hemisphere 1 on the pinched plate 11 can optionally cause more slippage between the drive wheel 13 and hemisphere 2, thus causing a relative decrease in spin rate and Magnus effect of the ball. Conversely, decreased traction of a second hemisphere on the pinched plate 11 can optionally allow less slippage and increased traction between the drive wheel 13 and the other hemisphere, thus causing a relative increase in spin rate and Magnus effect of the ball. Accordingly, the difference in spin rate of the ball when it is loaded traction side (e.g. hemisphere 1) up or down can be caused by a difference in on-wheel traction and/or on-pinch plate traction relative to the side exhibiting less traction (e.g. hemisphere 2).

As shown in FIGS. 3A and 3B, a drive wheel can optionally spin in a direction that produces back spin on the ball. Under this scenario, the ball when projected with a greater backspin, will undergo a greater Magnus effect and have a higher trajectory (FIG. 3A) relative to the ball when projected with less spin (FIG. 3B). The dominating interaction can be, for example, the last portion of the ball to contact the wheel. For example, depending on the location at which the ball first makes contact with the drive wheel, the ball may rotate one or more times while in contact with the drive wheel before disengaging from the drive wheel to begin its in-flight trajectory. Thus, a user, with only a few test pitches, can quickly compare loading positions and determine how to orient the ball to provide the hemisphere with more tractive surface as the dominating wheel-ball interaction to provide a relatively high trajectory (FIG. 3A) and determine how to orient the ball to provide the hemisphere with less tractive surface as the dominating wheel-ball interaction to provide a relatively low trajectory (FIG. 3B).

Example 4 Method of Throwing Ball with Controlled Vertical Trajectory and Controlled Lateral Trajectory A ball of the invention comprising a height-controlling structure and a horizontal trajectory controlling structure can be can be projected from a pitching machine, wherein the user can control the vertical trajectory and the horizontal trajectory. Further, while the instant application teaches various structural features for controlling horizontal trajectory and various structural features for controlling vertical trajectory, a ball of the invention may optionally comprise a hemisphere having a structural feature that controls both vertical and horizontal trajectory.

For example, the ball can have a hemisphere comprising a plurality of arcuate grooves, e.g. as detailed in Example 1, that are configured to control the horizontal trajectory and the vertical trajectory, e.g. depending upon how the hemisphere having the grooves is oriented when the ball is loaded in a pitching machine. Control of horizontal trajectory can occur as detailed in Example 2. Control of vertical trajectory can occur as detailed in Example 3.

Example 5 Manufacture of a Ball of the Invention

Figure 6A:
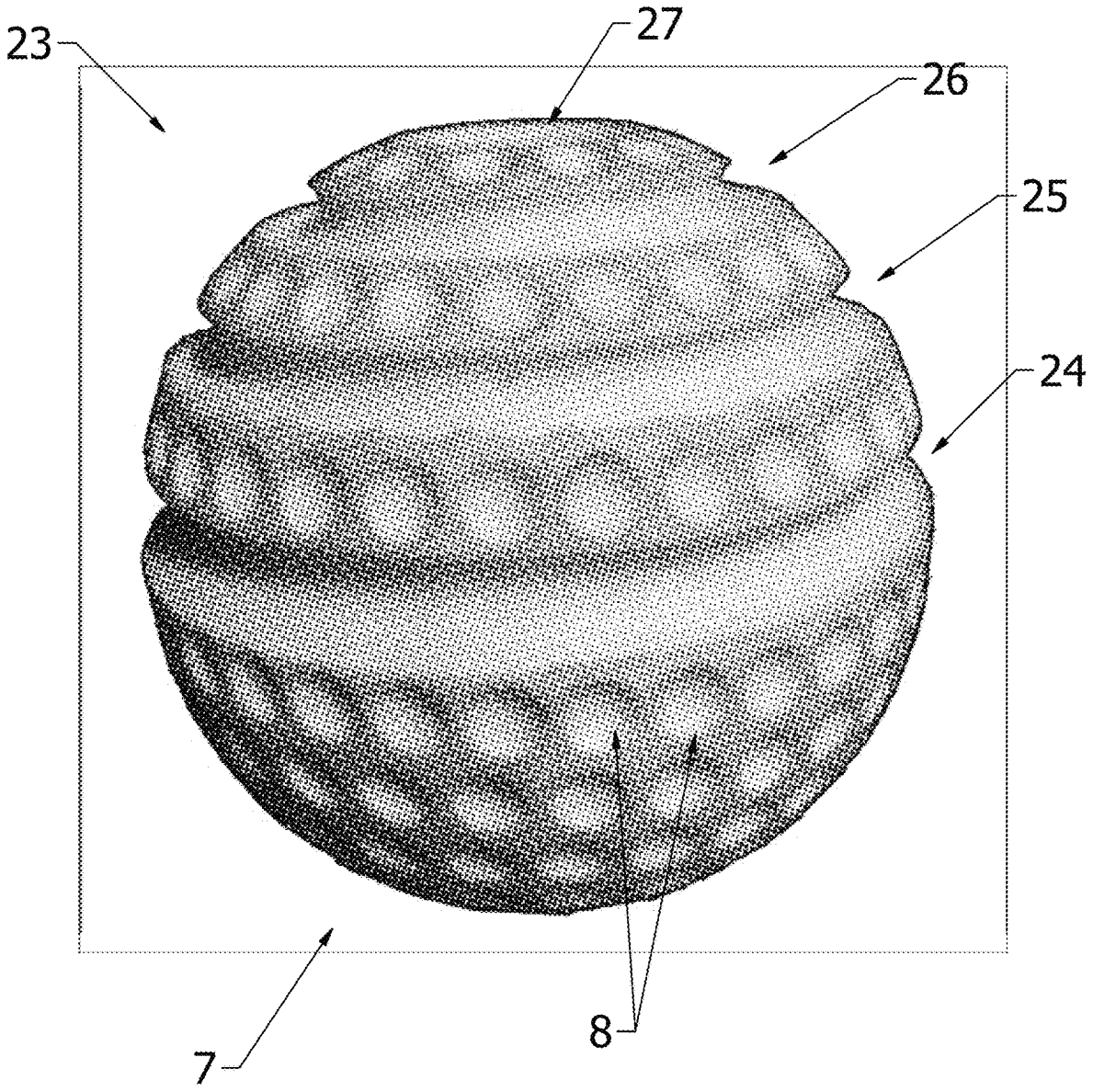
FIGS. 6A and 6B depict views of a ball of the invention.
Figure 6B:
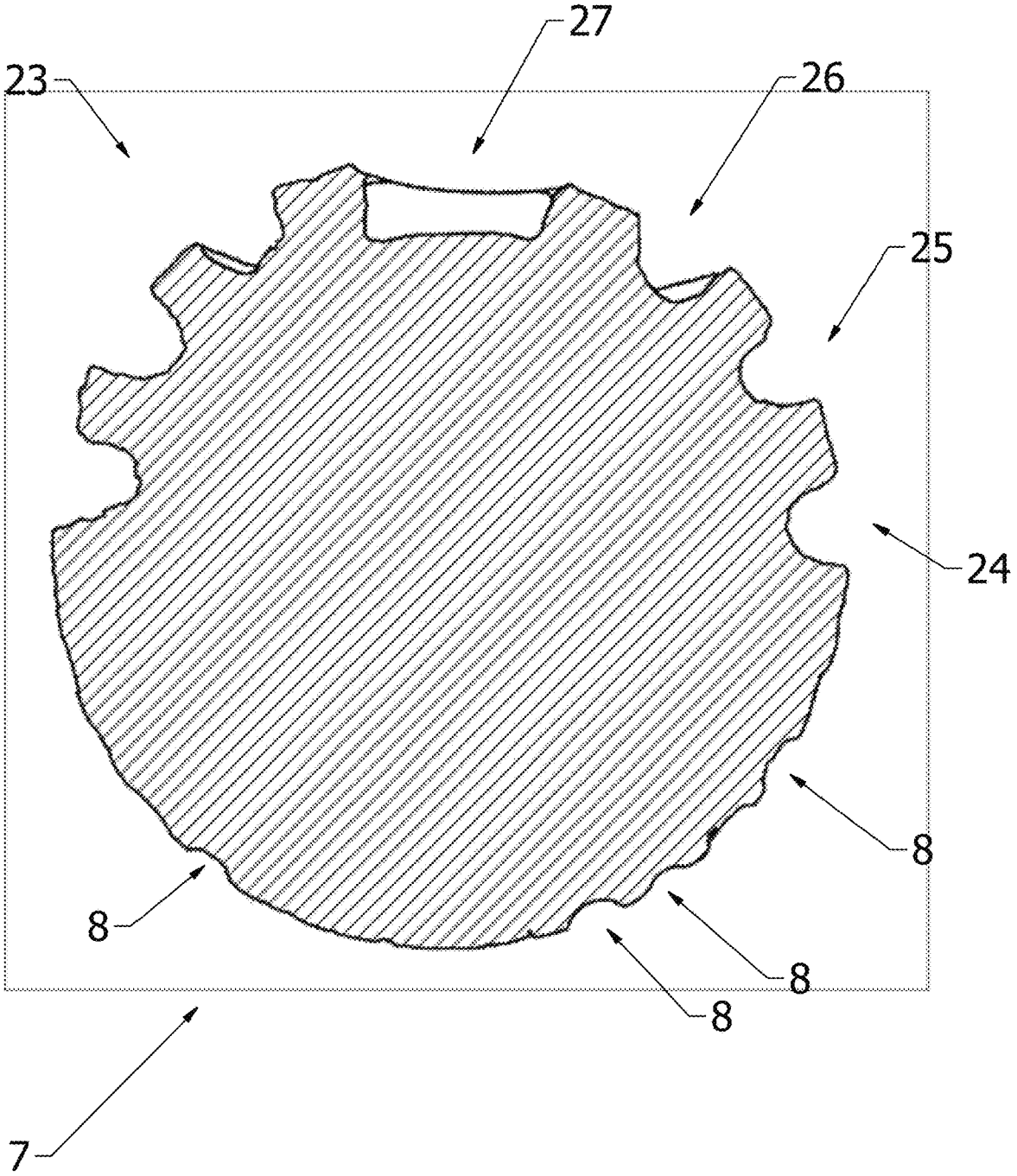

FIG. 6A depicts a photo of the ball of the invention made and tested by the inventor. FIG. 6B depicts a cross-section thereof showing the shape and depth of the grooves. The cross-section of FIG. 6B was digitally traced from a photo the ball after having been cut in half. The jagged edges shown in FIG. 6B were due to small pieces of foam that crumbled of the ball as it was being cut in half, and are not part of the ball detailed in this example.

To manufacture the ball, a molded polyurethane pitching machine ball (an example of a comparator ball relative to the ball of the invention detailed in the following example) was obtained weighing about 6.5 ounces and having a circumference of 12 inches and a hardness of 86 on the A-2 Shore durometer scale. The ball includes dimples across its entire surface. Using a ⅜ inch twist drill bit, a plurality of arcuate grooves 24, 25, 26 were cut around the ball. Using a ⅞ inch spade drill bit, a segment 27 was removed from the pole of the ball.

The depth of groove 24, the inner most groove adjacent to the equator, was about ⅜ in. The depth of groove 25, the middle groove, was about 5/16 in. The depth of the groove 26, the groove further from the equator, was about ¼ in. The spacing between grooves 24, 25, and 26 was about ⅜ in. The removed segment 27 had a depth of 7/32 in and a width of ⅞ in.

The ball weighed 5.8 ounces after the removal of material for creating the grooves and removed segment.

Example 6 Ball of the Invention

The ball of the invention was provided using the manufacturing process detailed in Example 5. The ball comprises a first hemisphere 23 and a second hemisphere 7.

The first hemisphere 23 comprises arcuate grooves 24, 25, and 26 positioned about respective planes that are parallel to each other and parallel to a plane comprising the equator that joins the first hemisphere 23 and second hemisphere 7. The first hemisphere 23 further comprises a removed segment 27 which comprised a flat recessed surface. The spacing of the grooves and the dimensions of the grooves and removed segment is as detailed in the previous example.

Each of the arcuate grooves 24, 25, and 26 completely surround or arc around the ball, as shown in FIG. 6A, and penetrate the ball in a "U" shape, as shown in FIG. 6B.

Hemisphere 7 comprises a plurality of dimples 8.

The ball has a circumference of 12 inches and weighs 5.8 ounces.

Example 7 Testing of a Prior Art Ball

A commercially available ball made to the specifications as disclosed by U.S. Pat. No. 6,354,970 B1 to Reinke et al. was obtained. Specifically, the ball was a Rawlings® Curveball Trainer ball. As described by Reinke, this ball has a hemisphere comprising grooves that impart curvature towards the hemisphere with the grooves when the ball is thrown and it spins on an axis extending through the hemisphere. As further described by Reinke, this ball is made extremely light to allow relative air pressure difference imparted by the grooves to provide a substantial curve to the ball. When the inventor attempted to load this ball into the pitching machine, it did not produce a satisfactory trajectory, namely the ball skipped on the drive wheel and bounced off, hitting the ground only a few feet away. In other words, the trajectory did not resemble that required for use of a ball with a pitching machine.

Example 8 Testing of a Prototype Ball

Prior to manufacturing the ball detailed in Example 5, the inventor manufactured a ball identical to that of Example 5, but having its grooves drilled to a shallower depth to mimic that of the Rawlings® Curveball Trainer ball. This experiment was conducted to determine if it were possible to induce a curve with a heavier ball that would be pitched from the pitching machine with a sufficient velocity. However, the ball, even when oriented in the manner known to produce a curveball (having grooves to the left or right), did not produce any curve at all. While it was expected that the curving effect would be less pronounced due to the heavier weight of the pitching machine ball, it was surprising, however, that the appeared to project with a perfectly straight trajectory. In other words, no curving effect was seen at all.

However, upon several attempts at differentially orienting the ball during loading of the ball into the pitching machine, it was surprisingly discovered that the user could control vertical trajectory by placing the grooved hemisphere side up or side down when loading the ball into the pitching machine. This effect is the same as detailed in FIGS. 3A and 3B and detailed in Example 3. This was quite surprising, for example, because it has never been suggested to alter the traction of a portion of a pitching machine ball to create a ball having multiple modes of pitching differentiated by their vertical trajectory. Further surprising is that surface shape such as grooves could be used to provide this altered traction.

Further surprising is that, depending of the depth of the grooves, the ball was able to be pitched with different lateral trajectories. The ball was modified from a ball having a substantially no lateral trajectory to a ball having a controllable lateral trajectory by deepening the grooves.

Example 9 Testing of a Ball of the Invention

The ball detailed in Example 6 was tested for is in-flight properties when projected from a pitching machine. The pitching machine included a drive wheel 13 as shown in FIG. 4. Specifically, the Jugs M1200 pitching machine was used, oriented horizontally, at a speed setting of 60 miles per hour (mph). The pitching machine was positioned 40 feet from home plate.

As with previous experiments, the ball of the invention surprisingly had a controllable vertical trajectory based on whether the grooved hemisphere was oriented side up or side down on the drive wheel of the pitching machine (e.g. in the manner detailed in FIGS. 3A and 3B). When oriented groove side down (high mode shown in FIG. 3A), the ball crossed home plate at a relatively high height. When oriented groove side up (low mode shown in FIG. 3B), the ball crossed home plate at a relatively low height. Further surprising is that, when a comparator pitching machine ball of identical composition, but not modified according to the present invention (i.e. the original retail pitching machine ball from which the invention was made by forming grooves) was projected from the pitching machine (i.e. a normal fastball), the ball crossed home plate at a height intermediate of the high ball mode and low ball mode of the ball of the invention. Accordingly, the low ball mode of projecting the ball of the invention was actually found to experience more drop than a normal fast ball. This is quite surprising because the ball-wheel interface is the same for both an unmodified ball and the low mode test inventive ball (i.e. a non-grooved surface). It was expected that the low mode of the ball of the invention would be experience the same drop as a normal fastball of a control comparator ball (i.e. an identical ball with the same composition except unmodified for traction according to the present invention) due to them having the same on-wheel traction. Thus, it is surprising that a ball of the invention optionally exhibits a low mode in which it experiences a greater drop relative to a respective comparator ball. Without being bound by theory, the inventor believes this phenomenon was due to unequal weights of hemispheres 1 and 2, which caused a small amount (unperceivable to the naked eye) of in-flight wobble during back spin. Presumably, this wobble either decreased the Magnus effect at the same back spin rate, or caused a slowing of the back-spin during its flight, also reducing the Magnus effect. Additionally or alternatively, the effect could have been caused by a reduced gyroscopic effect induced by wobble.

Further surprising is that the ball also had controllable lateral trajectory when the grooved hemisphere was oriented to the left or right in the manner detailed in FIGS. 5A and 5B. Specifically, the ball had a trajectory left of center (left of apex 22, FIG. 5B) when the ball was loaded with the grooves to the right side of the drive wheel and the ball had a trajectory right of center (left of apex 22, FIG. 5A) when the ball was loaded with the grooves to the left side of the drive wheel. This altered lateral trajectory appeared to be the result or both of a curving and angled trajectory.

The ball exhibited lateral deviation of several inches left or right from center (apex 22) after 40 feet in-flight projected at 60 mph.

Example 10 Modification of Ball Characteristics

Several balls were produced that were similar to the ball detailed in Example 6, except the groove dimensions were modified. It was found that lateral movement increased as groove depth increased and the difference in height between the ball projected in high mode and low mode increased as groove depth increased.

As in the previous example, the Jugs® M1200 pitching machine was used, oriented horizontally, at a speed setting of 60 miles per hour (mph). The pitching machine was positioned 40 feet from home plate.

Surprisingly, by configuring the grooves appropriately, a ball was produced exhibiting each of: a desired lateral movement of 9 inches left or right of center (when the grooved side is oriented to the left or right), a desired change in vertical movement between high ball mode and low ball mode (when the grooved side is oriented up or down) of 36 inches, a desired height when projected in high ball mode of 52 inches, and a desired height when projected in low ball mode of 16 inches. Accordingly, the difference in height of the ball when pitched grooved sided up verses grooved side down was about 36 inches after 40 feet in-flight projected at 60 mph from the M1200 pitching machine. This is quite remarkable that the modification of a ball with grooves was able to produce a ball with desired lateral movement, desired absolute heights of the low and high modes and desired height change of the high and low modes. These characteristics of desired lateral movement, high pitch height and low pitch height fall within desired ranges for typical batters (e.g. within or close to the strike zone of a typical batter).

The ball that provided the desired characteristics described above had groove depths of 5 mm, groove widths of 1 cm, a removed segment with a width of 2.2 cm width and 5 mm depth, and a total ball weight of 5.9 oz, which was 0.6 oz less than the starting weight of the ball before material removable by groove formation.

Other balls were similarly created having even deeper grooves and it was found that the vertical and horizontal trajectory could be modulated to a great extent, if desired (e.g. a difference in height of 50 inches of low mode vs high mode) and a lateral movement of much greater than the strike zone, e.g. laterally offset 15 inches or more from center). Thus, it was found that grooves could be created so deep that lateral movement and vertical changes were greater than desired for this particular application (pitching from 40 feet at 60 mph). Accordingly, a skilled artisan, with the teachings provided herein, can readily modify the in-flight characteristics of a ball to produce the desired effect.

Further, it is noted that lateral movement and absolute height can be modified by changing the weight of the ball. Further, it is noted that lateral movement and height can be independently modified. For example, the design can be modified by adding a tractive surface or lubricating surface to increase or decrease the change in height between high mode and low mode. As another example, the design can be modified by increasing or decreasing the difference in weight between two hemispheres to decrease or increase the absolute height. As another example, the design can be modified by modifying groove depth or adding or subtracting grooves to change the lateral movement and optionally adding a tractive or lubricating surface and/or changing the relative weight of the hemispheres to modify absolute height as discussed supra.

The citations provided herein are hereby incorporated by reference for the cited subject matter.

The invention also contemplates an ornamental design for any of the balls shown in the figures.

What is claimed is:

1. A sports ball comprising a first hemisphere and a second hemisphere, wherein:

a. the first hemisphere and the second hemisphere are non-overlapping;
b. the first hemisphere comprises a plurality of grooves;
c. the ball has a hardness of about 50 to about 100 measured by the A-2 Shore durometer scale;
d. the plurality of grooves are configured such that when the ball is projected from a drive wheel of a pitching machine such that an axis of rotation of the ball is between the first hemisphere and the second hemisphere, the trajectory of the ball is higher when the ball was loaded on the drive wheel such that the wheel-ball interaction is dominated by the first hemisphere compared to when the ball was loaded on the drive wheel such that the wheel-ball interaction is dominated by the second hemisphere;
e. the ball has a density of at least about 0.2 g/cm$^3$;
f. the plurality of grooves are arcuate grooves running parallel to an equator that separates the first hemisphere from the second hemisphere; and
g. the arcuate grooves are provided to a greater extent on the first hemisphere than the second hemisphere.

2. The sports ball of claim 1, wherein the second hemisphere does not comprises a plurality of grooves running parallel to the equator.

3. The sports ball of claim 1, wherein the second hemisphere does not comprise grooves.

4. The sports ball of claim 1, wherein grooves are provided to a greater extent on the first hemisphere grooves than the second hemisphere.

5. A method comprising projecting the sports claim 1 in conjunction with a pitching machine.

6. A sports ball comprising a first hemisphere and a second hemisphere, wherein:

a. the first hemisphere and the second hemisphere are non-overlapping;
b. the first hemisphere comprises a plurality of grooves;
c. the plurality of grooves are configured such that when the ball is projected from a drive wheel of a pitching machine after being oriented such that the first hemisphere is set laterally to a first side of a center plane of the drive wheel of the pitching machine such that an axis of rotation of the ball extends from the first hemisphere to the second hemisphere, the trajectory of the projected ball is offset laterally toward a second side of the center plane opposite the first side;
d. the ball has a density of at least about 0.2 g/cm$^3$; and
e. the plurality of grooves are arcuate grooves running parallel to an equator that separates the first hemisphere from the second hemisphere; and
f. the arcuate grooves are provided to a greater extent on the first hemisphere than the second hemisphere.

7. The sports ball of claim 6, wherein the second hemisphere does not comprises a plurality of grooves running parallel to the equator.

8. The sports ball of claim 6, wherein the second hemisphere does not comprise grooves.

9. The sports ball of claim 6, wherein grooves are provided to a greater extent on the first hemisphere grooves than the second hemisphere.

10. The sports ball of claim 6, wherein when the ball is projected from the drive wheel of the pitching machine, the trajectory of the ball is offset vertically when the ball was loaded on the drive wheel such that the wheel-ball interaction is dominated by the first hemisphere compared to when the ball was loaded on the drive wheel such that the wheel-ball interaction is dominated by the second hemisphere.

11. A method comprising projecting the sports claim 6 in conjunction with a pitching machine.

12. The sports ball of claim 6, wherein the grooves are elongated grooves.

13. A sports ball comprising a first hemisphere and a second hemisphere, wherein:

a. the first hemisphere and the second hemisphere are non-overlapping;

b. the first hemisphere comprises a plurality of grooves;

c. the plurality of grooves are configured such that when the ball is projected from a drive wheel of a pitching machine after being oriented such that the first hemisphere is set laterally to a first side of a center plane of the drive wheel of the pitching machine such that an axis of rotation of the ball extends from the first hemisphere to the second hemisphere, the trajectory of the projected ball is offset laterally toward a second side of the center plane opposite the first side;

d. the ball has a density of at least about 0.2 $g/cm^3$;

e. the plurality of grooves run parallel to an equator that separates the first hemisphere from the second hemisphere; and f. the grooves are continuous grooves.

14. The sports ball of claim 6, wherein the ball has a hardness of about 50 to about 100 measured by the A-2 Shore durometer scale.

* * * * *